US011721929B2

(12) United States Patent
DeWitt

(10) Patent No.: US 11,721,929 B2
(45) **Date of Patent: *Aug. 8, 2023**

(54) ELECTRICAL CONNECTOR WITH MODULAR HOUSING FOR ACCOMMODATING VARIOUS CONTACT LAYOUTS

(71) Applicant: Carlisle Interconnect Technologies, Inc., Kent, WA (US)

(72) Inventor: William James DeWitt, Camarillo, CA (US)

(73) Assignee: CARLISLE INTERCONNECT TECHNOLOGIES, INC., Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/394,337

(22) Filed: Aug. 4, 2021

(65) Prior Publication Data

US 2021/0384666 A1 Dec. 9, 2021

Related U.S. Application Data

(62) Division of application No. 16/702,435, filed on Dec. 3, 2019, now Pat. No. 11,114,796.
(Continued)

(51) Int. Cl.
*H01R 4/38* (2006.01)
*H01R 13/514* (2006.01)
(Continued)

(52) U.S. Cl.
CPC ..... *H01R 13/514* (2013.01); *H01R 13/424* (2013.01); *H01R 13/426* (2013.01); *H01R 13/512* (2013.01)

(58) Field of Classification Search
CPC .. H01R 13/622; H01R 13/625; H01R 13/595; H01R 13/512; H01R 13/514;
(Continued)

(56) References Cited

U.S. PATENT DOCUMENTS 3,955,871 A 5/1976 Kruger
4,191,443 A 3/1980 Doyle
(Continued)

FOREIGN PATENT DOCUMENTS

EP 2355258 A1 8/2011
FR 2611316 A2 8/1988
(Continued)

OTHER PUBLICATIONS

Amphenol Aerospace, OCS (Oval Contact System) Connectors, dated Jan. 2013, 7 pages.
(Continued)

*Primary Examiner* — Thanh Tam T Le
(74) *Attorney, Agent, or Firm* — Stoel Rives LLP

(57) ABSTRACT

The disclosure relates to an electrical connector having an electrical contact assembly housed within a cavity of a connector shell. The contact assembly includes a contact housing with a core extending in an axial direction and a plurality of fins radiating outwardly from the core, each of the fins separating adjacent housing-receiving cavities from one another. In an assembled configuration, a first plurality of electrical contacts is housed within a first housing receiving cavity and a second plurality of electrical contacts is housed within a second housing receiving cavity, where the first and second plurality of electrical contacts are different in type and structure from one another such that the electrical connector accommodates multiple contact layouts to improve overall functionality.

18 Claims, 16 Drawing Sheets

Related U.S. Application Data

(60) Provisional application No. 62/775,050, filed on Dec. 4, 2018.

(51) Int. Cl.
*H01R 13/424* (2006.01)
*H01R 13/426* (2006.01)
*H01R 13/512* (2006.01)

(58) Field of Classification Search
CPC .. H01R 13/424; H01R 13/426; H01R 23/688; H01R 23/025
See application file for complete search history.

(56) References Cited

U.S. PATENT DOCUMENTS

| | | | | |
|---|---|---|---|---|
| 4,193,655 | A | 3/1980 | Herrmann, Jr. | |
| 4,261,633 | A | 4/1981 | Abernethy | |
| 4,421,378 | A | 12/1983 | Sanford et al. | |
| 5,021,001 | A | 6/1991 | Ramirez | |
| 5,242,316 | A | 9/1993 | Gartzke et al. | |
| 5,393,242 | A | 2/1995 | Vanderstuyf | |
| 5,417,594 | A | 5/1995 | Herman et al. | |
| 5,538,440 | A * | 7/1996 | Rodrigues | H01R 4/2433 439/404 |
| 5,593,311 | A * | 1/1997 | Lybrand | H01R 24/62 439/607.11 |
| 5,643,016 | A | 7/1997 | Huss, Jr. | |
| 5,797,770 | A | 8/1998 | Davis et al. | |
| 6,077,122 | A * | 6/2000 | Elkhatib | H01R 13/5837 439/417 |
| 6,129,586 | A * | 10/2000 | Bellemon | H01R 13/6589 439/607.01 |
| 6,190,202 | B1 | 2/2001 | Lai | |
| 6,244,892 | B1 | 6/2001 | McCarthy | |
| 6,264,374 | B1 | 7/2001 | Selfridge et al. | |
| 6,328,601 | B1 | 12/2001 | Yip et al. | |
| 6,494,743 | B1 | 12/2002 | Lamatsch et al. | |
| 6,544,067 | B2 | 4/2003 | Hagmann | |
| 6,780,054 | B2 * | 8/2004 | Yip | H01R 13/6595 439/607.41 |
| 6,840,803 | B2 | 1/2005 | Wlos et al. | |
| 6,893,296 | B2 | 5/2005 | Aekins et al. | |
| 7,011,546 | B2 | 3/2006 | Vaccaro | |
| 7,153,168 | B2 | 12/2006 | Caveney et al. | |
| 7,172,466 | B2 | 2/2007 | Aekins et al. | |
| 7,195,518 | B2 | 3/2007 | Bert et al. | |
| 7,255,613 | B2 | 8/2007 | Mackey et al. | |
| 7,316,584 | B2 * | 1/2008 | Mackillop | H01R 13/6477 439/607.05 |
| 7,441,962 | B2 | 10/2008 | Penumatcha et al. | |
| 7,572,148 | B1 * | 8/2009 | Pepe | H01R 13/6589 439/607.05 |
| 7,637,776 | B2 | 12/2009 | McNutt et al. | |
| 7,736,159 | B1 | 6/2010 | Effinger, III et al. | |
| 8,007,319 | B2 | 8/2011 | Dang | |
| 8,029,322 | B1 | 10/2011 | Oh et al. | |
| 8,591,268 | B2 * | 11/2013 | Reimchen | H01R 13/622 439/701 |
| 8,764,471 | B2 | 7/2014 | Dang | |
| 8,894,448 | B2 * | 11/2014 | Affeltranger | H01R 13/6461 439/701 |
| 8,926,366 | B2 | 1/2015 | Dang | |
| 9,048,564 | B2 | 6/2015 | Dang | |
| 9,236,688 | B2 * | 1/2016 | Friedhof | H01R 13/6461 |
| 9,257,796 | B1 | 2/2016 | Dang | |
| 9,306,312 | B2 | 4/2016 | Dang | |
| 9,306,333 | B2 | 4/2016 | Dang | |
| 9,728,902 | B2 | 8/2017 | Höher et al. | |
| 9,806,451 | B2 | 10/2017 | Ono | |
| 9,954,305 | B2 * | 4/2018 | Yu | H01R 13/5219 |
| 11,114,796 | B2 * | 9/2021 | DeWitt | H01R 13/6586 |
| 11,177,615 | B2 * | 11/2021 | Ikehara | H01R 13/6589 |
| 2003/0096529 | A1 | 5/2003 | Brennan et al. | |
| 2004/0157493 | A1 | 8/2004 | Bergner et al. | |
| 2005/0148236 | A1 | 7/2005 | Montena | |
| 2008/0096433 | A1 | 4/2008 | Bixler et al. | |
| 2009/0104819 | A1 | 4/2009 | Hermant et al. | |
| 2010/0048061 | A1 | 2/2010 | Helmig et al. | |
| 2011/0088258 | A1 | 4/2011 | Gilliam | |
| 2012/0171884 | A1 | 7/2012 | Dang | |
| 2018/0026387 | A1 | 1/2018 | Annis et al. | |

FOREIGN PATENT DOCUMENTS

| | | | |
|---|---|---|---|
| FR | 2805932 | A1 | 9/2001 |
| FR | 2921522 | A1 | 3/2009 |
| WO | 0103247 | A1 | 1/2001 |
| WO | 2010115514 | A2 | 10/2010 |

OTHER PUBLICATIONS

European Patent Office, Extended European Search Report for Application No. 19213695.0, dated Apr. 20, 2020, 7 pages.
International Electrotechnical Commission, Publicly Available Specification IEC/PAS 61076-2-109 (Pre-Standard), Edition 1.0, dated Mar. 2010, 8 pages.
Phoenix Contact, Assembly Instructions, VS-08-M12MS-10G-P SCO and VS-08-M12MR-10G-P SCO, dated Mar. 2010, 1 page.
Siemon, Network Cabling Solutions, Siemon Z-MAX Category 6A Structured Cabling System, http://www.siemon.com/us/zMAX, visited Dec. 5, 2011, 8 pages.
Siemon, Network Cabling Solutions, Siemon's Z-MAX Structured Cabling Solution: Reinventing the RJ-45 for Tomorrow's Network, Feb. 2009, 12 pages.
Yoshitake, James, Interconnect Solutions for Aircraft Ethernet Data Networks, Defense Electronics Magazine, Oct. 2007, pp. 14-17, Penton Media, Inc.

* cited by examiner

ELECTRICAL CONNECTOR WITH MODULAR HOUSING FOR ACCOMMODATING VARIOUS CONTACT LAYOUTS

RELATED APPLICATION DATA

This application is a divisional of and claims the benefit under 35 U.S.C. § 121 from U.S. patent application Ser. No. 16/702,435, filed Dec. 3, 2019 and entitled "ELECTRICAL CONNECTOR WITH MODULAR HOUSING FOR ACCOMMODATING VARIOUS CONTACT LAYOUTS," which is a nonprovisional of and claims the benefit under 35 U.S.C. § 119(e) of U.S. Provisional Patent Application No. 62/775,050, filed Dec. 4, 2018, the disclosures of which are incorporated by reference herein in their entireties.

TECHNICAL FIELD

The field of this disclosure relates generally to electrical connectors and, particularly, to an electrical connector system having a modular design for accommodating different contact layouts in a single connector to improve overall functionality.

BACKGROUND

Increasingly, electronic devices transmit and receive high-frequency electrical signals representing digital data. High-speed data transmission, such as so-called Ultra High-Speed (UHS) data transmission involves the transmission of data between electronic devices at rates of 1 to 10 gigabits per second using signal frequencies of 100 MHz to 500 MHz. As technology progresses and electronic devices become increasingly complex, high-speed data transmission at even faster rates and at even higher frequencies may be required. In addition, high-speed digital data networks may not be confined to terrestrial applications, especially as high-speed electronics continue being developed for aerospace and other suitable applications. In some of these environments, space may be limited, and so the electrical connectors must continue being capable of transmitting data at high-speeds while maintaining a compact footprint. Moreover, in aerospace and other applications, electrical connectors are subjected to a variety of harsh environmental conditions, such as the presence of moisture, vibrations and mechanical shock, relatively high amounts of external electrical and magnetic interference, and pressure changes, all of which can detrimentally affect an electrical connector's performance.

Because degraded performance of an electrical connector adversely affects the ability of a system to transfer data at high rates, the present inventor has recognized a need for a robust electrical connector capable of facilitating high-speed data transfer in aerospace and other suitable applications, such as aircraft electronic systems. The present inventor has also recognized a need for such an improved electrical connector with a streamlined design for handling various contact layouts to provide multi-functional capabilities via a single electrical connector. Additional aspects and advantages will be apparent from the following detailed description of preferred embodiments, which proceeds with reference to the accompanying drawings.

BRIEF DESCRIPTION OF THE DRAWINGS

FIG. 4 is a partially exploded view of the electrical connector system of FIGS. 1-3.

DETAILED DESCRIPTION OF EXAMPLE EMBODIMENTS

Figure 1:
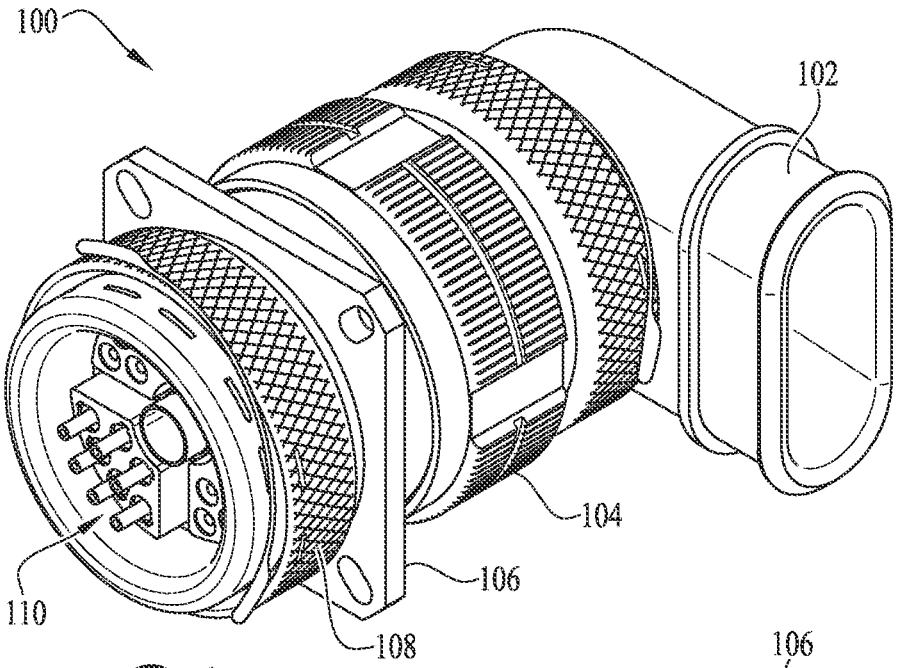
FIGS. 1-3 illustrate various views of an electrical connector system according to one embodiment.
Figure 2:
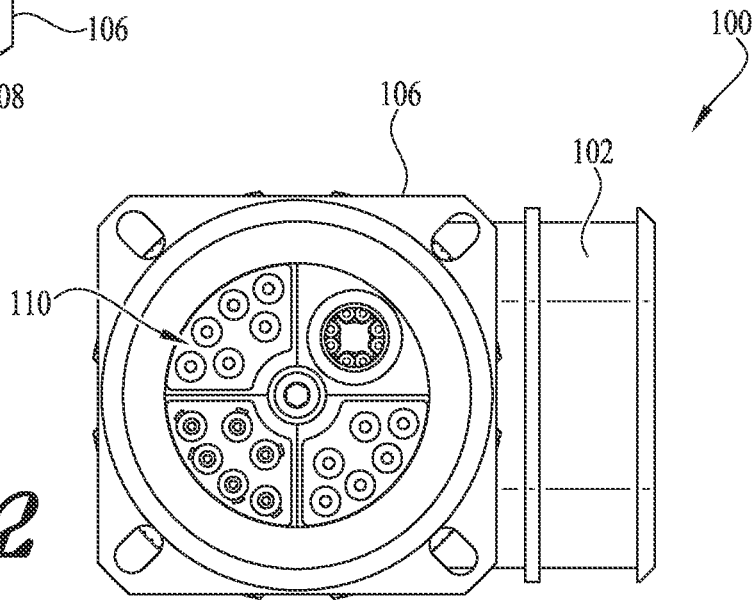
Figure 3:
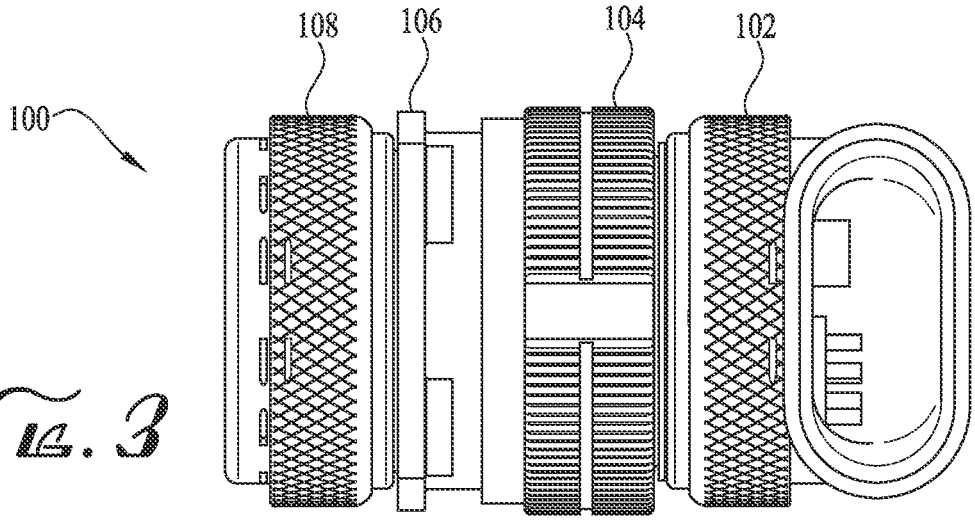
Figure 1:
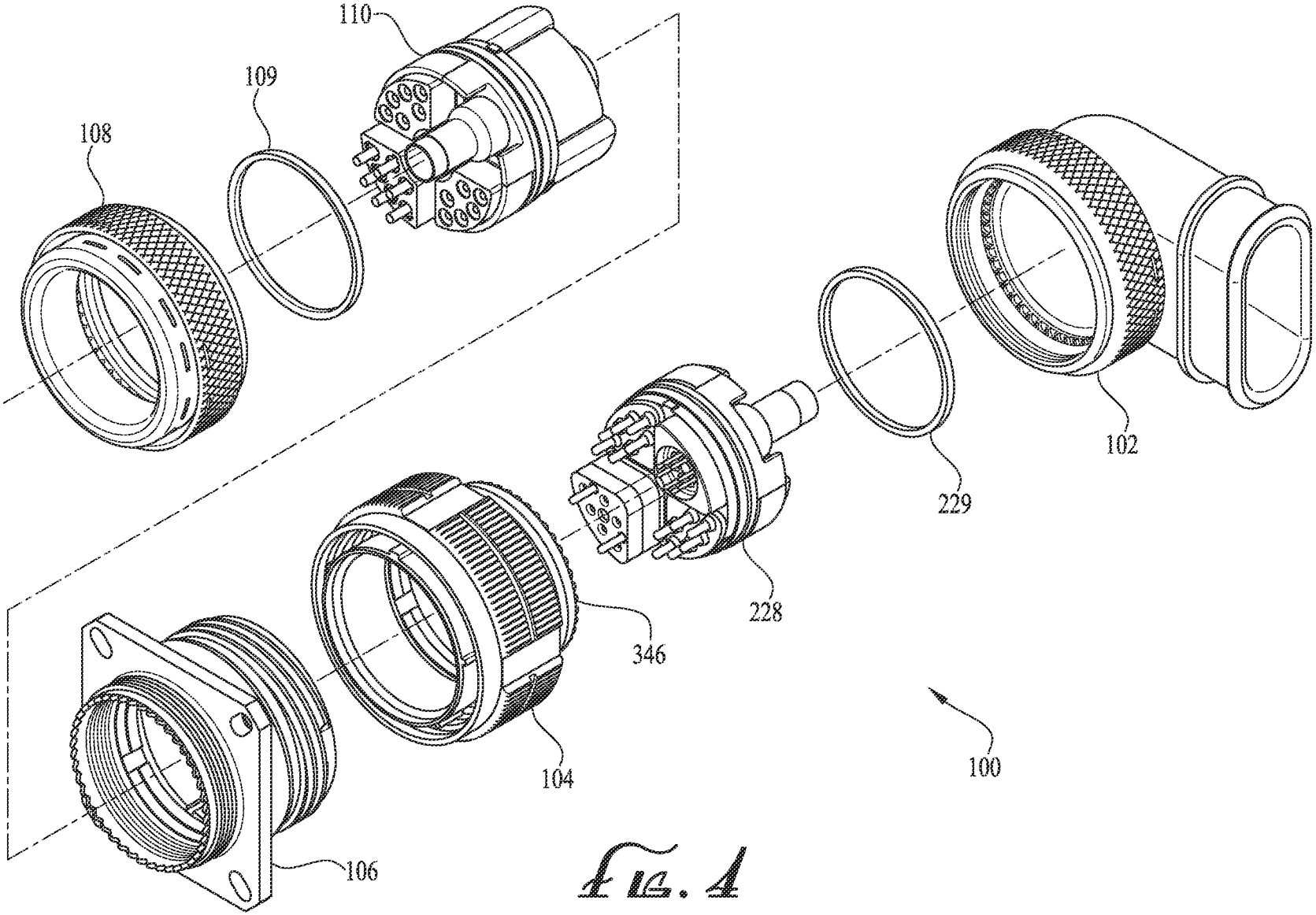

With reference to the drawings, this section describes various embodiments of an electrical connector system and its detailed construction and operation. Throughout the specification, reference to "one embodiment," "an embodiment," or "some embodiments" means that a described feature, structure, or characteristic may be included in at least one embodiment of the electrical connector system. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like.

The following passages describes example embodiments of an electrical connector system that may be used for high-speed data transfer in aerospace or other suitable applications, such as aircraft electronic systems. In the following description, certain components of the electrical connector system are described in detail. It should be understood that in some instances, well-known structures, materials, or operations are not shown or not described in detail to avoid obscuring more pertinent aspects of the embodiments. In addition, although certain embodiments may reference electrical connectors having a specific arrangement and number of pin and socket contacts, other embodiments may include differently configured components adapted to house more or fewer contacts than the illustrated embodiments.

With general reference to the figures, the following description relates to an electrical connector system designed with contact subassemblies that can be customized and arranged as desired to accommodate various types of contact layouts. For example, the electrical connector system may include various contact subassemblies, such as sets of fiber optic contacts, coax contacts, and other pin/socket contacts that may be combined in a shared housing to provide a single electrical connector with the flexibility to perform multiple functions, such as deliver power, transmit signals, and transmit data. As noted previously, the electrical connectors may be used in the aircraft electronic systems.

As designed, the electrical connector system allows for each contact subassembly to be installed individually and housed within a common connector housing. Because each connector subassembly is installed individually and is smaller as compared to an ordinary electrical connector with similar contacts, the disclosed electrical connector design simplifies routing the electrical wires and connectors through confined spaces, as is common in certain environments of use, such as aircrafts. In addition, the repair and maintenance processes are simplified since the damaged or otherwise deficient connectors/wires can easily be removed and replaced from the electrical connector system when needed. Similarly, upgrades may be performed quickly by removing and replacing any of the contact subassemblies without having to replace entire electrical connector systems.

As illustrated in the figures, the following electrical connector system may satisfy all specifications for 38999 connectors and arinc 801, and may be used for size 25 shells. In other embodiments, the electrical connector system may accommodate other shell sizes and/or connector types as desired. For ease of understanding, the embodiments illustrated in the figures and described below relate to contact subassemblies of the electrical connector system where the contact subassemblies each include one full set of identical contacts (e.g., one subassembly includes only fiber optic contacts or only coax contacts). In other embodiments, the contact subassemblies may include a mixed arrangement of contacts as desired. For example, one contact subassembly may include two size 16 socket contacts, two size 16 coax contacts, and four size 22 socket contacts. It should be understood that other arrangements are possible. As further described in detail below, the electrical connector system features a streamlined design with minimal components to reduce overall weight and size, while achieving a desired level of performance. Additional details and features of the electrical connector system are provided below with reference to the figures.

FIGS. 1-4 illustrate details of an electrical connector system 100 in accordance with one example embodiment. With reference to FIG. 1, the electrical connector system 100 has a variety of interlocking components including a backshell 102, a plug shell with a coupling nut 104, a receptacle shell 106, and a backshell 108. These components are designed to collectively mate with one another to securely house the electrical contacts and other components of the electrical connector system 100 (see FIG. 4). Additional details relating to specific features of the backshell 102 and the backshell 108 are further described with reference to FIGS. 28-34 below. Turning to the exploded view of FIG. 4, the following briefly describes an example arrangement of the interior components of the electrical connector system 100 in accordance with one embodiment.

With reference to FIG. 4, the electrical connector system 100 includes a socket contact assembly 110 and a pin contact assembly 228, each of which housing multiple contact types in a physically separated configuration as further described in detail below. It should be understood that while the embodiments illustrated in the figures and described below relate to one specific arrangement of contact layouts, in other embodiments, various different contact types may be selected as desired to provide the electrical connector system 100 with multi-functional capabilities as previously mentioned.

In an assembled configuration of the electrical connector system 100, the backshell 102, plug shell 104, receptacle shell 106, and backshell 108 each include cavities for receiving the contact assemblies 110, 228 as collectively shown in FIGS. 1-4. When assembled, an internal retaining ring (not shown) positioned within backshell 108 exerts force on a first spacer ring 109, which in turn exerts force on the socket contact assembly 110. Similarly, an internal retaining ring (not shown) positioned within the backshell 102 exerts force on a second spacer ring 229, which in turn exerts force on the pin contact assembly 228. The spacer rings 109, 229 each include a captive O-ring (not shown) on their respective interior faces (i.e., the face abutting the respective contact assemblies 110, 228). In this configuration, the O-ring in the spacer ring 109 absorbs the tolerance difference between each of the socket contact inserts in the socket contact assembly 110. Similarly, the O-ring in the spacer ring 229 absorbs the tolerance difference between each of the pin contact inserts in the pin contact assembly 228. This design helps secure the contact assemblies 110, 228 within the electrical connector system 100, and helps ensure an equal distribution of forces on all inserts in the respective assemblies 110, 228. The following proceeds with specific details of an arrangement of the socket contact assembly 110 with reference to FIGS. 5-15, followed by specific details of an arrangement of the pin contact assembly 228 with reference to FIGS. 16-27, and details of various connector backshell embodiments with reference to FIGS. 28-34.

Figure 5:
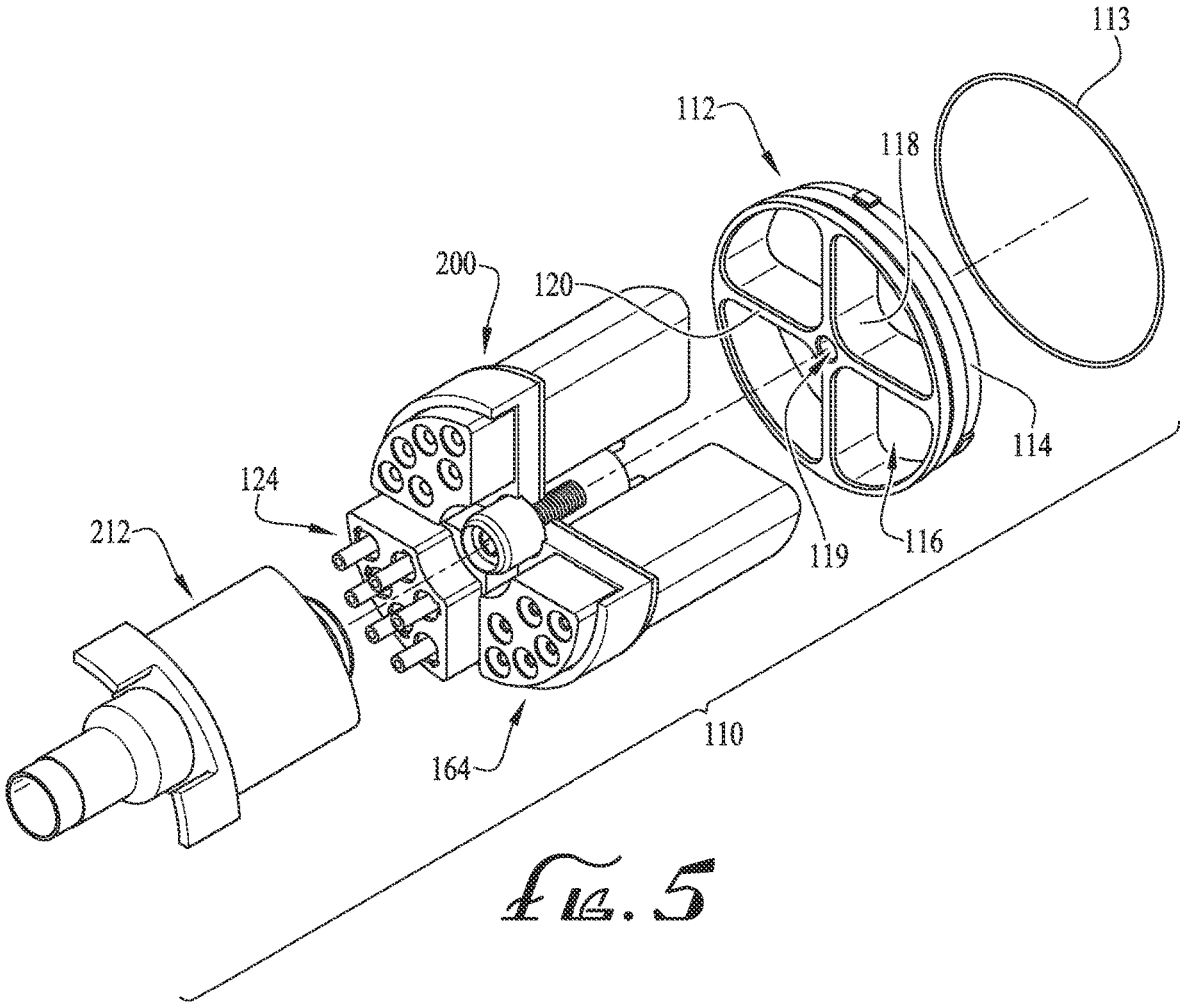
FIG. 5 is a partially exploded view of a socket contact assembly of the electrical connector system of FIGS. 1 and 2 in accordance with one embodiment.
Figure 6:
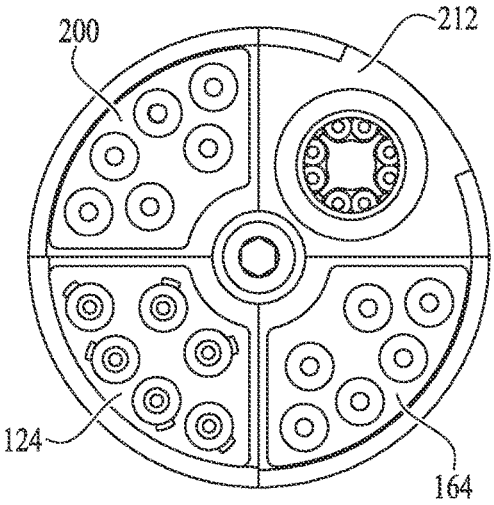
FIGS. 6 and 7 are top and bottom views, respectively, of the socket contact assembly of FIG. 5 illustrating various types of socket contacts.
Figure 7:
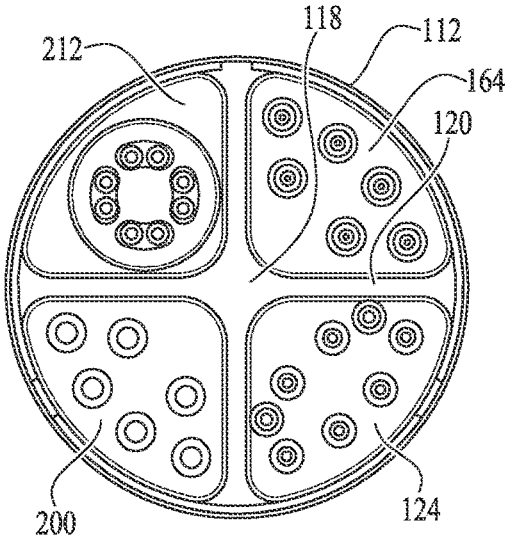

FIGS. 5-7 collectively illustrate features and components of the socket contact assembly 110 in accordance with one embodiment. As illustrated in FIG. 5, the socket contact assembly 110 may include a plurality of different electrical contact subassemblies arranged therein. The following passages describe a general layout of the socket contact assembly 110 before describing each of the electrical contact subassemblies in turn with reference to the figures.

FIG. 5 illustrates a partially exploded view of the socket contact assembly 110, and FIGS. 6 and 7 illustrate top and bottom views, respectively, of the socket contact assembly 110. With collective reference to FIGS. 5-7, the socket contact assembly 110 includes a substantially circular contact retention housing 112 configured for arranging and securely retaining the plurality of contacts in an aligned configuration. The contact retention housing 112 may be made from any suitable materials, such as aluminum or titanium. In some embodiments, the contact retention housing 112 includes an exterior surface 114 having a generally round shape (although other suitable shapes may be used in other electrical connector designs), and includes a plurality of cavities 116 extending entirely through the contact retention housing 112, where each cavity 116 is open at both a front face and an opposite rear face of the contact retention housing 112 as illustrated. The contact retention housing 112 includes a central core 118 having a plurality of fins 120 radiating outwardly therefrom, the fins 120 physically separating adjacent cavities 116 from one another to define standalone compartments for retaining the different electrical contact subassemblies as further described below. An O-ring 113 encircles the exterior surface 114 of the contact retention housing 112 to help seal the socket contact assembly 110 when positioned within the receptacle shell 106.

Figures 8, 9:
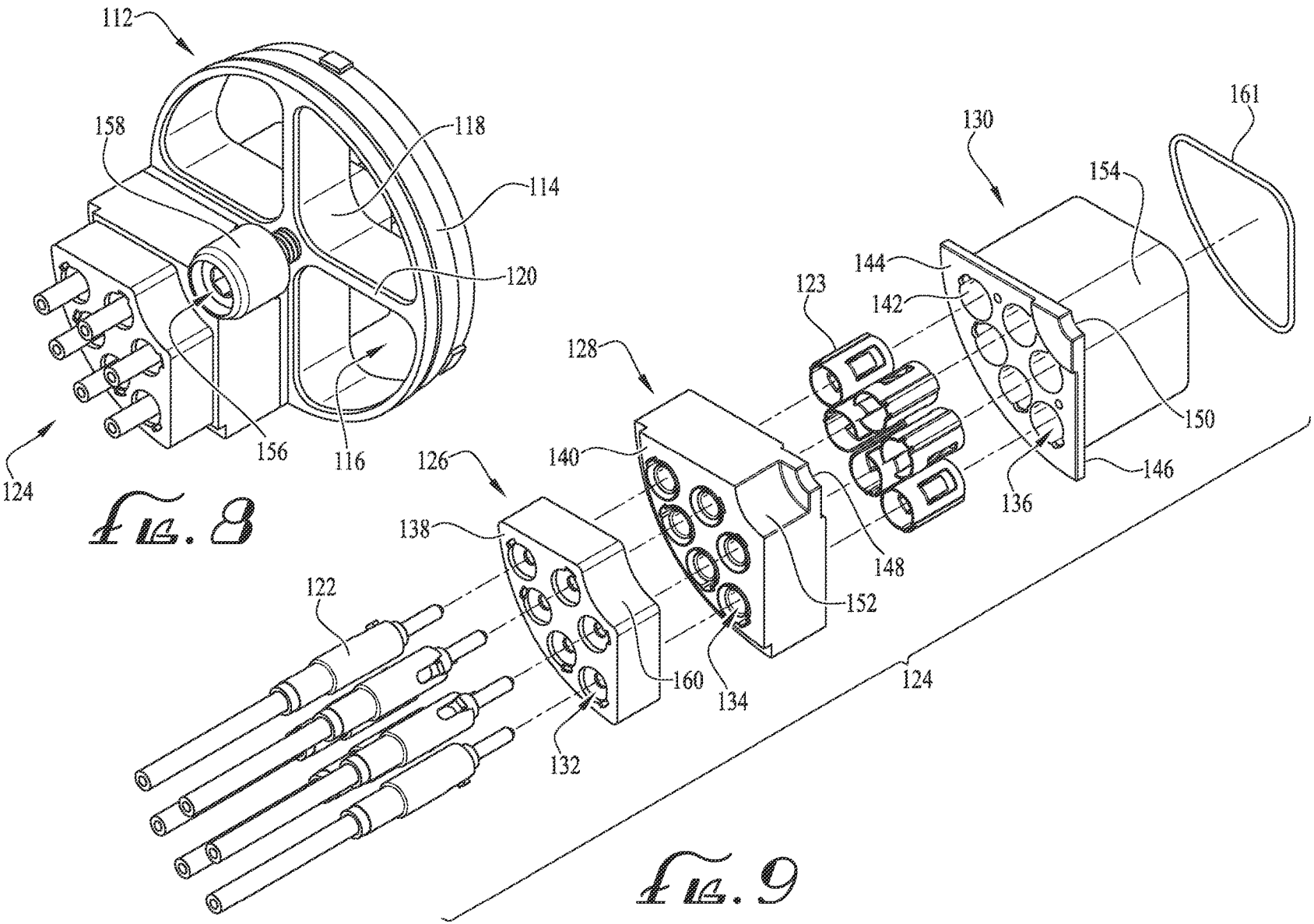
FIGS. 8-15 collectively illustrate various views of an arrangement of socket contacts for the socket contact assembly of FIG. 5 in accordance with one embodiment.

FIGS. 8 and 9 collectively illustrate details of a first multi-part housing structure 124 having a first plurality of contacts 122 arranged therein for the electrical connector system 100. As noted previously, the contacts 122 may be any suitable contacts, such as fiber optic contacts as illustrated in FIG. 9. It should be understood that in other embodiments, the electrical connector system 100 may include different electrical contacts within multi-part housing structure 124.

With reference to FIGS. 8 and 9, the multi-part housing structure 124 includes a wire sealing grommet 126, a first housing 128, and a second housing 130. In some embodiments, the housings 128, 130 of the multi-part housing structure 124 may be made from any suitable material, such as aluminum, titanium, diallyl phthalate, or thermoplastic materials (such as polyether ether ketone, polyetherimide, or polybutylene terephthalate). In other embodiments, the multi-part housing structure 124 may be made from other suitable materials without dielectric properties.

With reference to FIG. 9, the grommet 126 and housings 128, 130 each include a plurality of co-aligned cavities 132, 134, 136 extending entirely therethrough. The grommet 126 and housings 128, 130 may include any number of such cavities 132, 134, 136 arranged in any suitable manner. In an assembled configuration, the contacts 122 are seated within the respective cavities 132, 134, 136 of the grommet 126 and housings 128, 130. In some embodiments, contact retention clips 123 may be inserted as well to ensure the contacts 122 are securely retained in position within the multi-part housing structure 124.

Preferably, the grommet 126 and housings 128, 130 each include a respective peripheral side surface 138, 140, 142 that substantially matches the shape of the exterior surface 114 of the contact retention housing 112 to ensure that the grommet 126 and housings 128, 130 are properly seated within the contact retention housing 112 during the assembly process. In some embodiments, a top surface 144 of the second housing 130 includes a lip 146 extending outwardly along a periphery of the top surface 144, wherein the lip 146 provides an exterior periphery for the second housing 130 that is wider than the remainder of its body. In an assembled configuration, the multi-part housing structure 124 is inserted through one of the cavities 116 of the contact retention housing 112 until the lip 146 of the second housing 130 rests against a top surface of a pair of adjacent fins 120 to retain the multi-part housing structure 124 within the contact housing 112 (see FIG. 8). In some embodiments, a gasket 161 may be positioned underneath the lip 146 to ensure the contact housing 112 is properly sealed when seated within the housing 112.

Returning to FIG. 9, the first housing 128 may include a first flange 148, and the second housing 130 may include a second flange 150, where each flange 148, 150 extends outwardly from an interior face 152, 154 of the respective housings 128, 130. In this configuration, a fastener 156 (e.g., a screw or other suitable fastener) may be used to further couple/secure the multi-part housing structure 124 to the contact housing 112. In one arrangement, the fastener 156 extends through an opening 119 (see FIG. 5) formed through the core 118 of the contact retention housing 112, where an underside of a head 158 of the fastener 156 sits against the flanges 148, 150 to secure the multi-part housing structure 124. To further accommodate the fastener 156, the interior portions 152, 154 of the respective housings 128, 130 may be notched, recessed, or otherwise shaped to form a groove or surface matching a shape of the fastener 156 and head 158. For example, FIG. 8 illustrates a fastener 156 with a rounded head 158. Accordingly, the interior faces 152, 154 of the respective housings 128, 130 may be curved inwardly to a suitable radius that corresponds with the curvature of the exterior rounded surface of the head 158. In some embodiments, the wire sealing grommet 126 may also include a corresponding notch or groove formed along an interior portion 160 to further facilitate the assembly process for securing the multi-part housing structure 124.

Figures 10, 11:
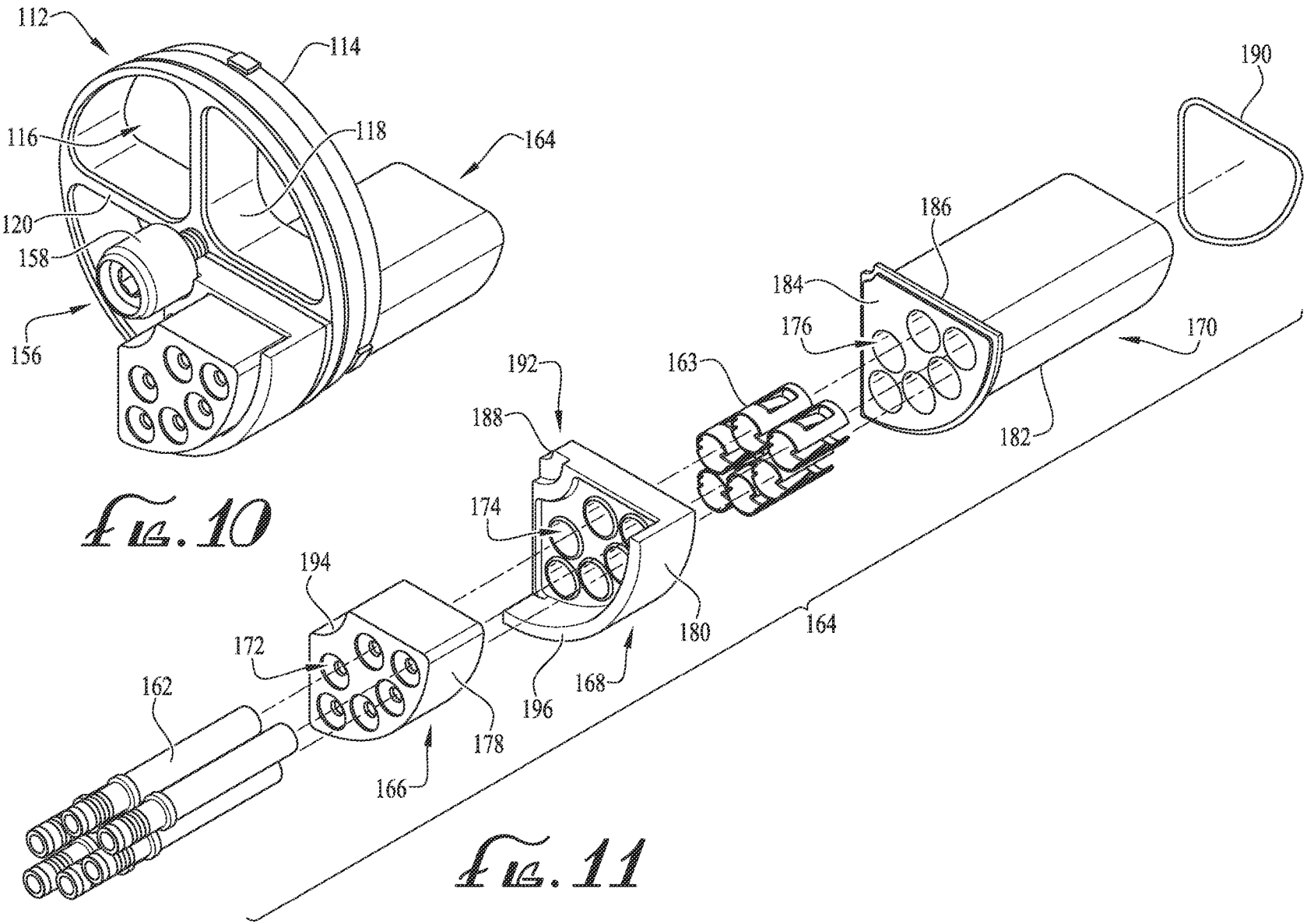

FIGS. 10 and 11 collectively illustrate details of a second multi-part housing structure 164 having a second plurality of contacts 162 arranged therein for the electrical connector system 100, where the contacts 162 may be different than the plurality of contacts 122 of FIG. 8. In one embodiment, the plurality of contacts 162 may be size 16 socket contacts as illustrated in FIGS. 10 and 11. It should be understood that in other embodiments, the electrical connector system 100 may include different electrical contacts within multi-part housing structure 164.

With reference to FIGS. 10 and 11, the multi-part housing structure 164 includes a wire sealing grommet 166, a first housing 168, and a second housing 170 generally disposed in a similar arrangement as described previously with reference to FIGS. 8 and 9. In some embodiments, the multi-part housing structure 164 may be made from any suitable material with desirable electrical insulation and heat resistance properties, preferably a thermoset plastic material (such as diallyl phthalate) or a thermoplastic material (such as polyether ether ketone, polyetherimide, or polybutylene terephthalate).

With reference to FIG. 11, the grommet 166 and housings 168, 170 each include a plurality of co-aligned cavities 172, 174, 176 extending entirely therethrough. The grommet 166 and housings 168, 170 may include any number of such cavities 172, 174, 176 arranged in any suitable manner. In an assembled configuration, the contacts 162 are seated within the respective cavities 172, 174, 176 of the grommet 166 and housings 168, 170. In some embodiments, contact retention clips 163 may be inserted as well to ensure the contacts 162 are securely retained in position within the multi-part housing structure 164.

Preferably, the grommet 166 and housings 168, 170 each include a respective peripheral side surface 178, 180, 182 that substantially matches the shape of the exterior surface 114 of the contact retention housing 112 to ensure that the grommet 166 and housings 168, 170 are properly seated within the contact retention housing 112 during the assembly process. As illustrated in FIG. 11, the grommet 166 may have a slightly smaller size than the corresponding grommet 126 illustrated in FIG. 8 primarily due to the size differences in contacts. Accordingly, in some embodiments, the first housing 168 may include an exterior wall or border 196 extending along a portion of the peripheral surface 180 to securely receive the grommet 166 when assembled. In such embodiments, the border 196 essentially fills in the space to ensure the multi-part housing 164 sits securely within the contact retention housing 112.

In some embodiments, a top surface 184 of the second housing 170 includes a lip 186 extending outwardly along a periphery of the top surface 184, wherein the lip 186 provides an exterior periphery for the second housing 170 that is wider than the remainder of its body. In an assembled configuration, the multi-part housing structure 164 is inserted through one of the cavities 116 (a different cavity 116 than the one retaining the contacts 122 of FIG. 8) of the contact retention housing 112 until the lip 186 of the second housing 170 rests against a top surface of each of a pair of adjacent fins 120 to retain the multi-part housing structure 164 within the contact housing 112 (see FIG. 10). In some embodiments, a gasket 190 may be positioned underneath the lip 186 to ensure the contact retention housing 112 is properly sealed when seated within the housing 112.

With reference to FIG. 11, the first housing 168 may include a flange 188 extending outwardly from an interior face 192 of the housing 168. The flange 188 is designed for receiving the fastener 156 to secure the multi-part housing structure 164 within the contact retention housing 112 in a similar fashion as described previously with reference to FIG. 8. To further accommodate the fastener 156, the interior faces 192, 194 of the respective housing 168, and grommet 166 may be notched, recessed, or otherwise shaped to form a groove or surface matching a shape of the fastener 156 and head 158 in a similar fashion as described previously.

Figures 12, 13:
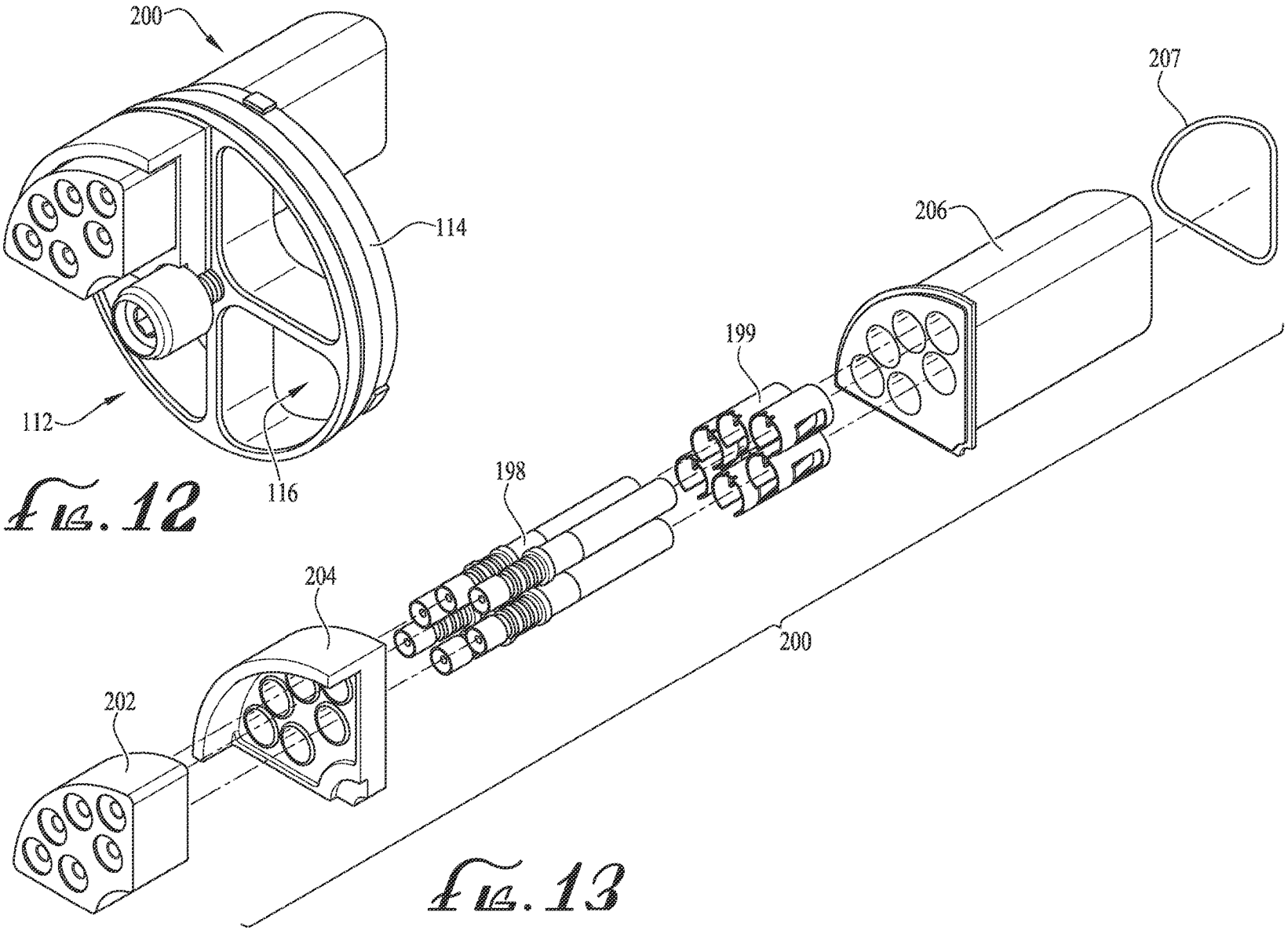

FIGS. 12 and 13 collectively illustrate details of a third multi-part housing structure 200 having a third plurality of contacts 198 and contact retention clips 199 arranged therein for the electrical connector system 100, where the contacts 198 may be different than the plurality of contacts 122, 162 of FIGS. 8 and 10, respectively. In one embodiment, the plurality of contacts 198 may be size 16 socket coax contacts as illustrated in FIGS. 12 and 13. It should be understood that in other embodiments, the electrical connector system 100 may include different electrical contacts within multi-part housing structure 200.

With reference to FIGS. 12 and 13, the multi-part housing structure 200 includes a wire sealing grommet 202, a first housing 204, a second housing 206, and a sealing gasket 207 arranged in a substantially similar configuration as described previously with reference to multi-part housing structure 164 of FIGS. 10 and 11. In some embodiments, the housings 204, 206 of the multi-part housing structure 200 may be made from any suitable material, such as aluminum or titanium, diallyl phthalate, or thermoplastic materials (such as polyether ether ketone, polyetherimide, or polybutylene terephthalate). In other embodiments, the multi-part housing structure 200 may be made from other suitable materials without dielectric properties.

As illustrated in FIGS. 12 and 13, the features and components of the grommet 202 and housings 204, 206 may be substantially similar to those discussed with reference to the grommet 166 and housings 168, 170 of FIGS. 10 and 11. Accordingly, the following passages will not further describe the features of grommet 202 and housings 204, 206 to avoid repetition, but it should be understood that the description with reference to the features of the grommet 166 and housings 168, 170 in FIGS. 10 and 11 equally applies to the grommet 202 and housings 204, 206 in the embodiment of FIGS. 12 and 13. As illustrated in FIG. 11, the multi-part housing structure 200 and contacts 198 are inserted into one of the cavities 116 of the contact retention housing 112.

Figures 14, 15:
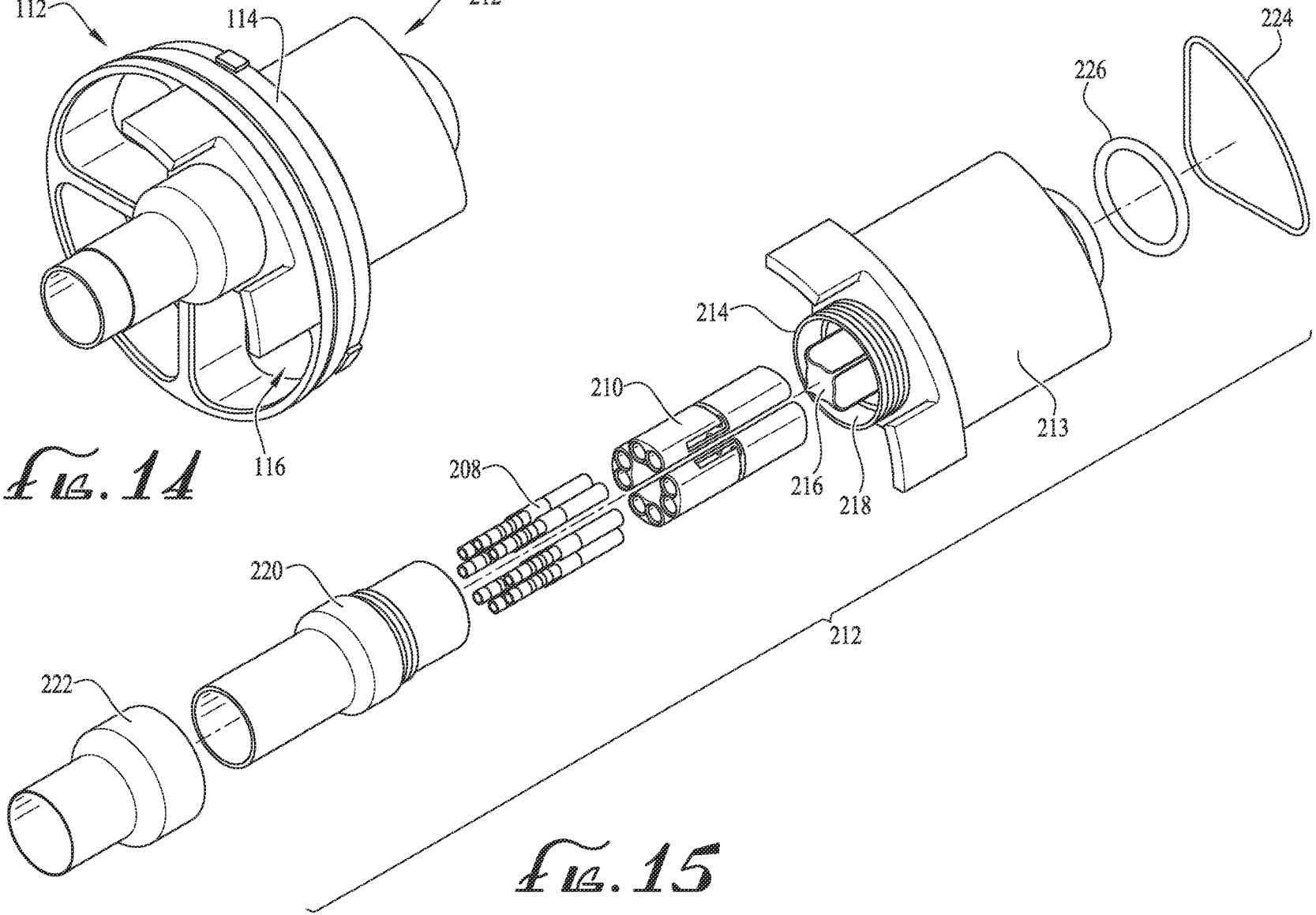

FIGS. 14 and 15 collectively illustrate details of a fourth multi-part housing structure or insert 212 having a fourth plurality of contacts 208 arranged therein for the electrical connector system 100, where the contacts 208 may be different than contacts 122, 162, 198 of the previous embodiments. With reference to FIGS. 14 and 15, in one embodiment, the plurality of contacts 208 may be arranged in groups of eight in a similar fashion as described in the high-density electrical connector of U.S. Pat. No. 9,306,333, the disclosure of which is incorporated herein in its entirety.

With reference to FIG. 15, the plurality of contacts 208 may be housed in sets of two inside electrically insulating (or electrically non-conductive) sheaths 210, wherein the sheaths 210 physically separate individual socket contacts 208 from one another. An insert 212 includes a body 213 having a plurality of cavities 214 for housing and arranging the sheaths 210 and contacts 208. In some embodiments, the body 213 may be made from any suitable material, such as aluminum or titanium. In other embodiments, the body 213 may be made from other suitable materials without dielectric properties. The cavities 214 are physically separated from one another via a conductive core 216 and fins 218 radiating outwardly from the core 216, where each cavity 214 extends in an axial direction entirely through the insert body 213. The socket contacts 208 are retained by the sheaths 210 which are in turn retained in position within the body 213 via housing member 220 and housing member 222, which is in turn threaded onto the body 213. In some embodiments, a gasket 224 and O-ring 226 may be positioned on the body 213 to ensure proper sealing when the insert 212 is positioned within the contact retention housing 112.

Figure 16:
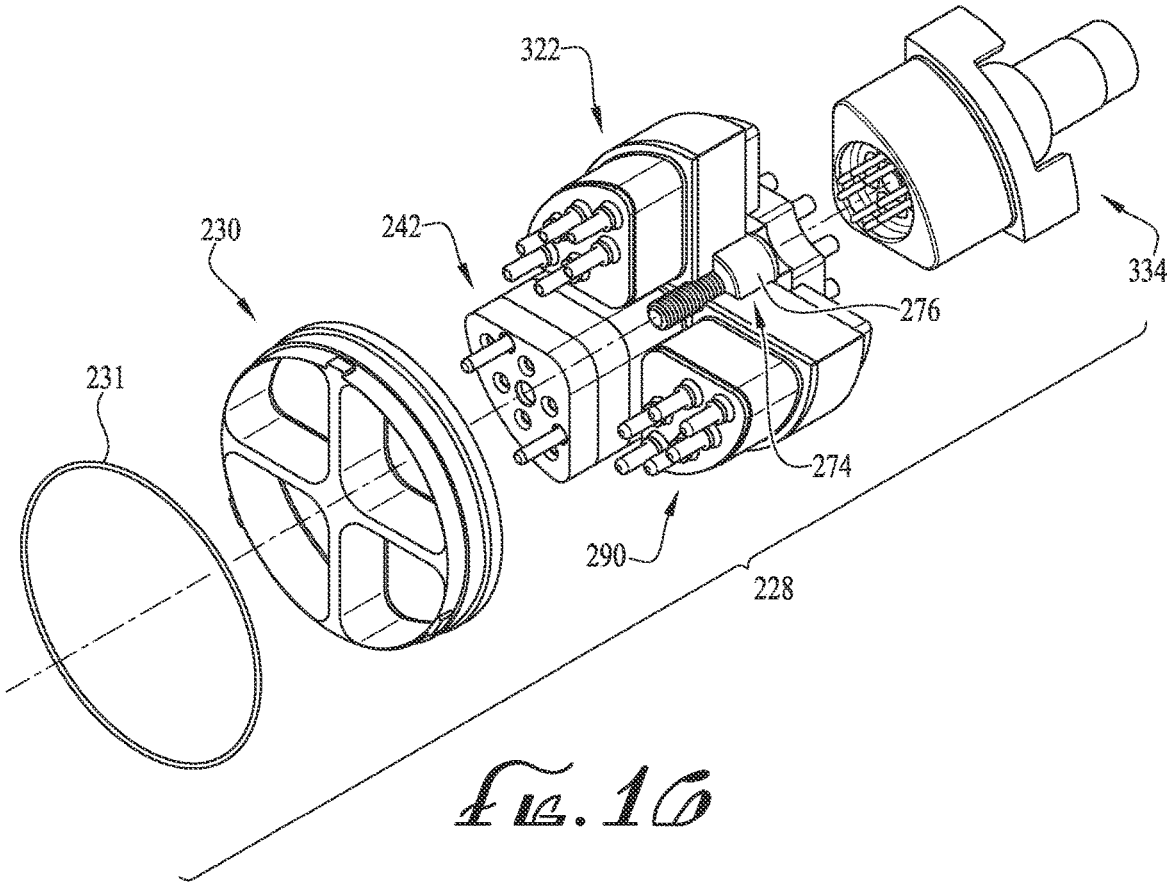
FIG. 16 is a partially exploded view of a pin contact assembly of the electrical connector system of FIGS. 1 and 2 in accordance with one embodiment.
Figure 17:
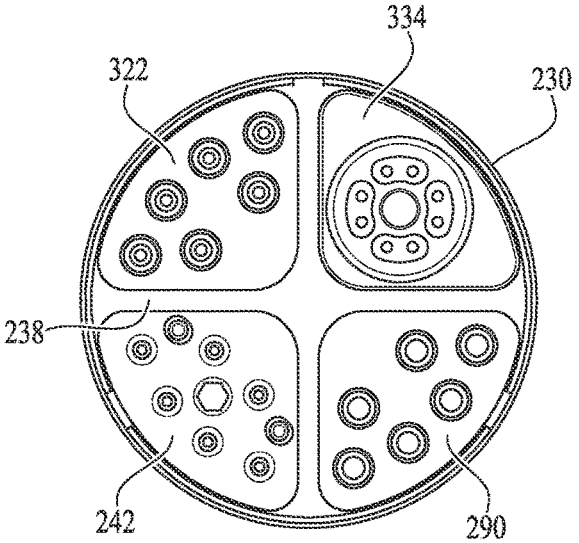
FIGS. 17 and 18 are top and bottom views, respectively, of the pin contact assembly of FIG. 16 illustrating various types of pin contacts.
Figure 18:
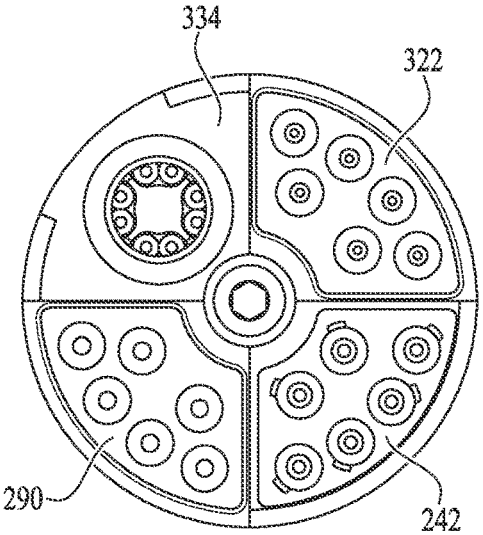

FIGS. 16-18 collectively illustrate features and components of the pin contact assembly 228 in accordance with one embodiment. As illustrated in FIG. 16, the pin contact assembly 228 may include a plurality of different electrical contact subassemblies arranged therein. The following passages describe a general layout of the pin contact assembly 110 before describing each of the electrical contact subassemblies in turn with reference to the figures.

FIG. 16 illustrates a partially exploded view of the pin contact assembly 228, and FIGS. 17 and 18 illustrate top and bottom views, respectively, of the pin contact assembly 228. With collective reference to FIGS. 16-18, the pin contact assembly 228 includes a contact retention housing 230 for arranging and securely retaining the plurality of contacts in an aligned configuration. The contact retention housing 230 is substantially similar to the contact retention housing 112 described previously with reference to FIG. 5 and includes the same features and components. For example, the contact retention housing 230 includes an exterior surface 232 having a generally round shape (although other suitable shapes may be used in other electrical connector designs), and includes a plurality of cavities 234 extending entirely through the contact retention housing 230, where each cavity 234 is open at both a front face and an opposite rear face of the contact retention housing 230. The contact retention housing 230 includes a central core 236 having a plurality of fins 238 radiating outwardly therefrom, the fins 238 physically separating adjacent cavities 234 from one another to define standalone compartments for retaining the different contact types as further described below. An O-ring 231 encircles the exterior surface 232 of the contact retention housing 230 to help seal the pin contact assembly 228 when positioned in the plug shell 104.

Figures 19, 20, 21:
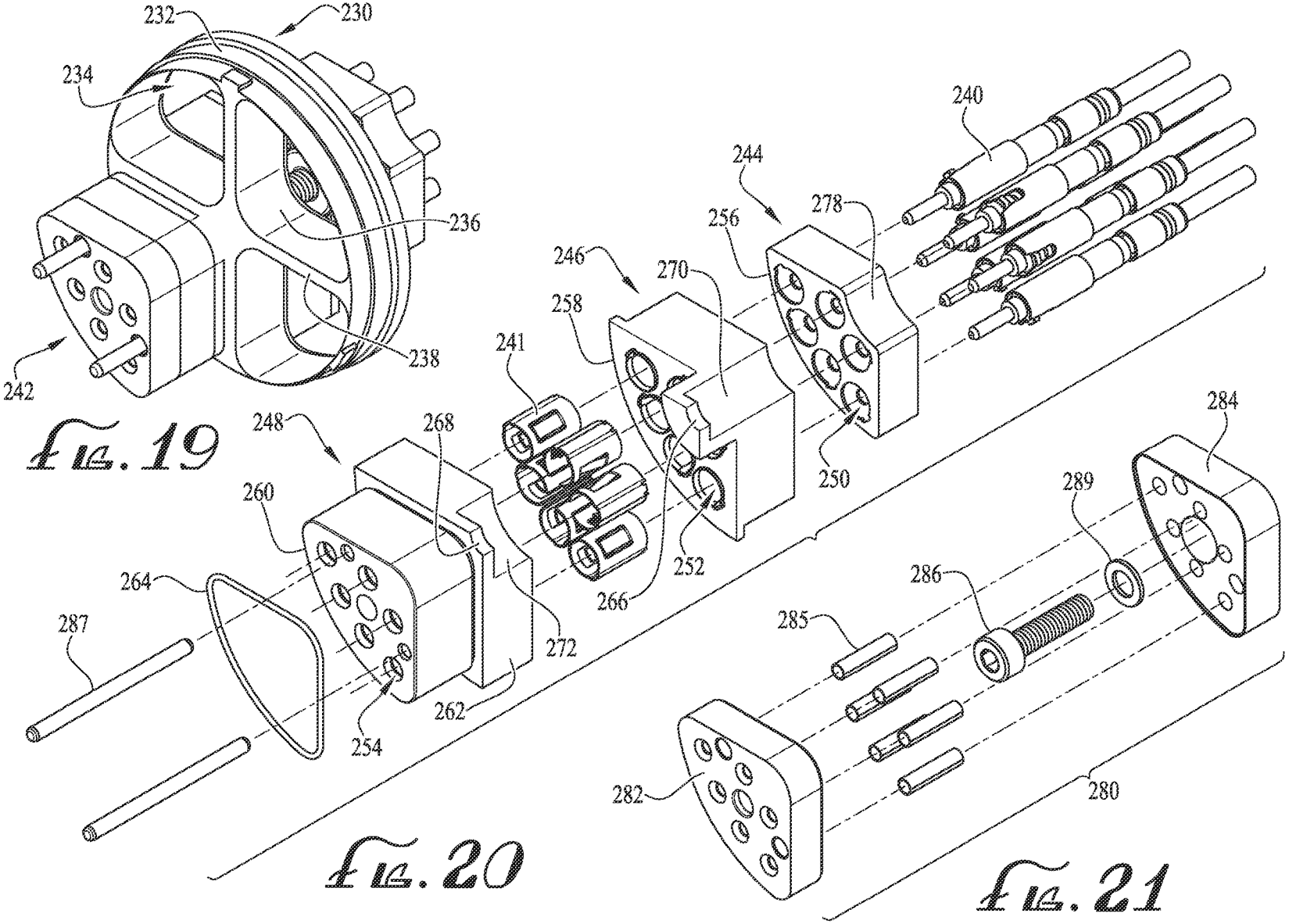
FIGS. 19-27 collectively illustrate various views of an arrangement of pin contacts for the pin contact assembly of FIG. 16 in accordance with one embodiment.

FIGS. 19-21 collectively illustrate details of a first multi-part housing structure 242 having a first plurality of contacts 240 arranged therein for the electrical connector system 100. As noted previously, the contacts 240 may be any suitable contacts, such as fiber optic contacts as illustrated in FIG. 19. Preferably, the contacts 240 correspond to the type and size of contacts 122 of FIGS. 8 and 9. It should be understood that in other embodiments, the electrical connector system 100 may include different electrical contacts within multi-part housing structure 242 other than fiber optic contacts.

With reference to FIGS. 19-21, the multi-part housing structure 242 includes a wire sealing grommet 244, a first housing 246, and a second housing 248 arranged in a similar fashion as described previously with reference to FIG. 8. In some embodiments, the housings 246, 248 of the multi-part housing structure 242 may be made from any suitable material, such as aluminum, titanium, diallyl phthalate, or thermoplastic materials (such as polyether ether ketone, polyetherimide, or polybutylene terephthalate). In other embodiments, the multi-part housing structure 242 may be made from other suitable materials without dielectric properties.

With reference to FIG. 20, the grommet 244 and housings 246, 248 each include a plurality of co-aligned cavities 250, 252, 254 extending entirely therethrough. The grommet 244 and housings 246, 248 may include any number of such cavities 250, 252, 254 arranged in any suitable manner. In an assembled configuration, the contacts 240 are seated within the respective cavities 250, 252, 254 of the grommet 244 and housings 246, 248. In some embodiments, contact retention clips 241 may be inserted as well to ensure the contacts 240 are securely retained in position within the multi-part housing structure 242.

Preferably, the grommet 244 and housings 246, 248 each include a peripheral side surface 256, 258, 260 that substantially matches the shape of the exterior surface 232 of the contact retention housing 230 to ensure that the grommet 244 and housings 246, 248 are properly seated within the contact retention housing 230 during the assembly process. In some embodiments, a portion of the second housing 248 includes a shoulder 262 having an exterior dimension that is wider than the remainder of the body of the second housing 248. In an assembled configuration, the multi-part housing structure 242 is inserted through one of the cavities 234 of the contact retention housing 230 until the shoulder 262 of the second housing 248 is wedged against or between a pair of adjacent fins 238 to retain the multi-part housing structure 242 within the contact housing 230 (see FIG. 19). In some embodiments, a gasket 264 may be positioned against the shoulder 262 to ensure the contact housing 230 is properly sealed when seated within the housing 230.

Returning to FIG. 20, the first housing 246 may include a first flange 266, and the second housing 248 may also include a second flange 268, where each flange 266, 268 extends outwardly from an interior face 270, 272 of the respective housings 246, 248. In this configuration, a fastener 274 (e.g., a screw or other suitable fastener as illustrated in FIG. 16) may be used to further couple/secure the multi-part housing structure 242 to the contact housing 230. In one arrangement, the fastener 274 extends through an opening (not shown) formed through the core 236 of the contact retention housing 230, where an underside of a head 276 of the fastener 274 sits against the flanges 266, 268 to secure the multi-part housing structure 242. To further accommodate the fastener 274, the interior faces 270, 272 of the respective housings 246, 248 may be notched, recessed, or otherwise shaped to form a groove or surface matching a shape of the fastener 274 and head 276 as described in previous embodiments. In some embodiments, the wire sealing grommet 244 may also include a corresponding notch, recess, or groove formed along an interior face 278 to further facilitate the assembly process for securing the multi-part housing structure 242.

As illustrated in FIG. 21, the electrical connector system 100 may include an alignment sleeve holder 280 having a first housing 282 and a second housing 284 coupled together via a fastener 286 and washer 289. The housings 282, 284 may be made from any suitable material, such as aluminum, titanium, diallyl phthalate, or thermoplastic materials (such as polyether ether ketone, polyetherimide, or polybutylene terephthalate). The sleeve holder 280 houses and holds split ceramic alignment sleeves 285, each sleeve 285 coupled with a corresponding contact 240 when the assembly is completed. The fastener 286 and two alignment pins 287 are used to couple the sleeve holder 280 to the multi-part housing structure 242 adjacent the second housing structure 248. In an assembled configuration, the sleeve holder 280 is used to maintain near perfect alignment of the mated housing structures 124 (see FIG. 5) and 242. As noted previously, these housing structures 124, 242 house corresponding contacts of the same type and size.

Figures 22, 23:
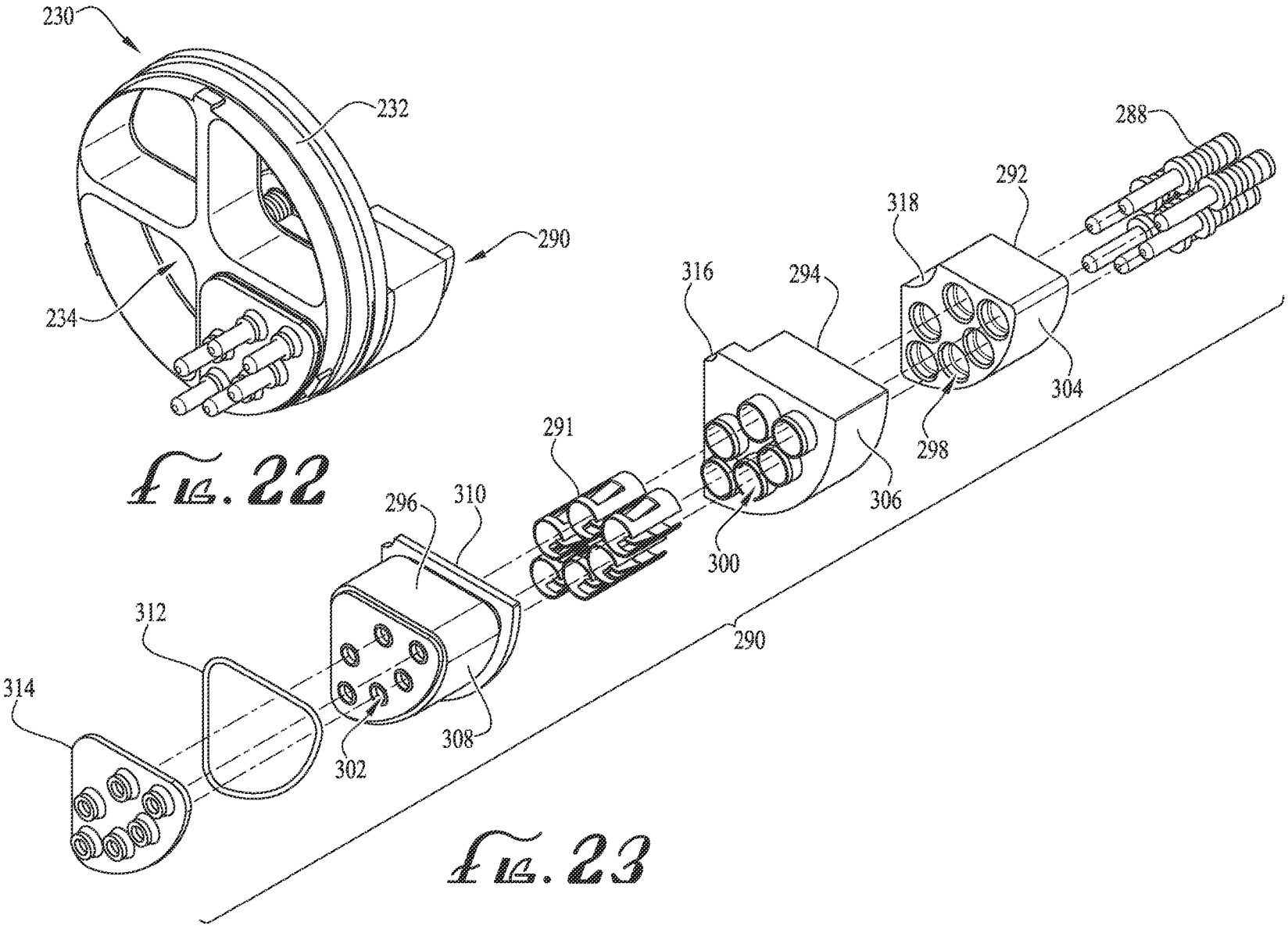

FIGS. 22 and 23 collectively illustrate details of a second multi-part housing structure 290 having a second plurality of contacts 288 arranged therein for the electrical connector system 100, where the contacts 288 may be different than the plurality of contacts 240 of FIG. 19. In one embodiment, the plurality of contacts 288 may be size 16 pin contacts corresponding to the size 16 socket contacts 162 of FIG. 10. It should be understood that in other embodiments, the electrical connector system 100 may include different electrical contacts, other than pin contacts, within multi-part housing structure 290.

With reference to FIGS. 22 and 23, the multi-part housing structure 290 includes a wire sealing grommet 292, a first housing 294, and a second housing 296. In some embodiments, the multi-part housing structure 290 may be made from any suitable material with desirable electrical insulation and heat resistance properties, preferably a thermoset plastic material (such as diallyl phthalate) or a thermoplastic material (such as polyether ether ketone, polyetherimide, or polybutylene terephthalate).

With reference to FIG. 23, the grommet 292 and housings 294, 296 each include a plurality of co-aligned cavities 298, 300, 302 extending entirely therethrough. The grommet 292 and housings 294, 296 may include any number of such cavities 298, 300, 302 arranged in any suitable manner. In an assembled configuration, the contacts 288 are seated within the respective cavities 298, 300, 302 of the grommet 292 and housings 294, 296. In some embodiments, contact retention clips 291 may be inserted as well to ensure the contacts 288 are securely retained in position within the multi-part housing structure 290. Preferably, the grommet 292 and housings 294, 296 each include a respective peripheral side surface 304, 306, 308 that substantially matches the shape of the exterior surface 232 of the contact retention housing 230 to ensure that the grommet 292 and housings 294, 296 are properly seated within the contact retention housing 230 during the assembly process.

In some embodiments, the second housing 296 includes a lip 310 extending outwardly therefrom, wherein the lip 310 provides an exterior periphery for the second housing 296 that is wider than the remainder of its body. In an assembled configuration, the multi-part housing structure 290 is inserted through one of the cavities 234 (i.e., a different cavity 234 than the one retaining the contacts 240 of FIG. 19) of the contact retention housing 230 until the lip 310 of the second housing 296 rests against a top surface of each of a pair of adjacent fins 238 to retain the multi-part housing structure 290 within the contact housing 230. In some embodiments, a gasket 312 may be positioned underneath the lip 310 to ensure the contact retention housing 230 is properly sealed when seated within the housing 230. In other embodiments, the multi-part housing structure 290 may include an interfacial seal 314 seated against the second housing 296 to help support and align the pin contacts 288 extending therethrough.

With reference to FIG. 23, the first housing 294 may include a flange 316 extending outwardly from a portion of the first housing 294. The flange 316 is designed for receiving the fastener 274 (see FIG. 16) to secure the multi-part housing structure 290 within the contact retention housing 230 in a similar fashion as described previously. To further accommodate the fastener 274, an interior face (not shown) of the first housing 294 and an interior face 318 of the grommet 292 may be notched, recessed, or otherwise shaped to form a groove or surface matching a shape of the fastener 274 in a similar fashion as described previously.

Figure 24:
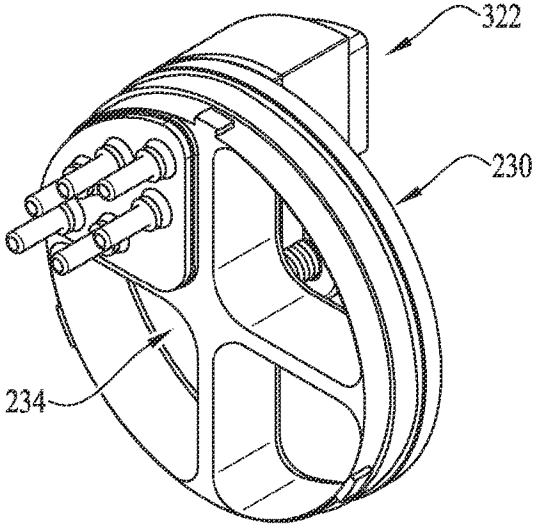
Figure 25:
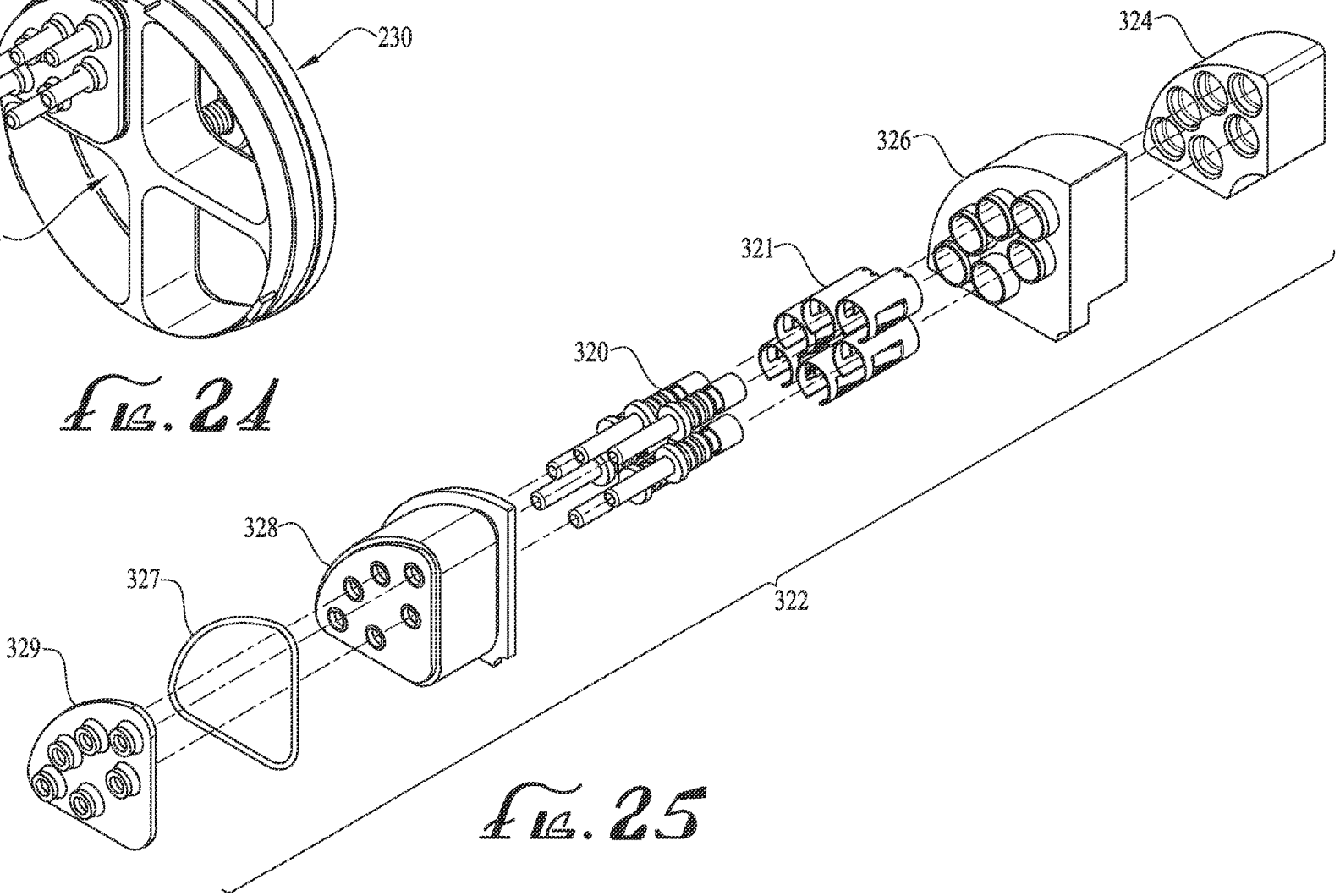

FIGS. 24 and 25 collectively illustrate details of a third multi-part housing structure 322 having a third plurality of contacts 320 and contact retention clips 321 arranged therein for the electrical connector system 100, where the contacts 320 may be different than the plurality of contacts 240, 288 of FIGS. 19 and 22, respectively. In one embodiment, the plurality of contacts 320 may be size 16 pin coax contacts as illustrated in FIGS. 24 and 25. It should be understood that in other embodiments, the electrical connector system 100 may include different electrical contacts within multi-part housing structure 322.

With reference to FIGS. 24 and 25, the contacts 320 and contact retention clips 321 may be seated within a multi-part housing structure 322 including a wire sealing grommet 324, a first housing 326, a second housing 328, a seal/gasket 327, and an interfacial seal 329 arranged in a substantially similar manner as described previously with reference to multi-part housing structure 290 of FIGS. 22 and 23. In some embodiments, the housings 326, 328 of the multi-part housing structure 322 may be made from any suitable material, such as aluminum, titanium, diallyl phthalate, or thermoplastic materials (such as polyether ether ketone, polyetherimide, or polybutylene terephthalate). In other embodiments, the multi-part housing structure 322 may be made from other suitable materials without dielectric properties.

As illustrated in FIGS. 24 and 25, the features and components of the grommet 324 and housings 326, 328 may be substantially similar to those discussed with reference to the grommet 292 and housings 294, 296 of FIGS. 22 and 23. Accordingly, the following will not further describe the features of grommet 324 and housings 326, 328 to avoid repetition, but it should be understood that the description with reference to the features of the grommet 292 and housings 294, 296 in FIGS. 22 and 23 equally applies to the grommet 324 and housings 326, 328 in the embodiment of FIGS. 24 and 25. As illustrated in FIG. 25, once assembled, the multi-part housing structure 322 and contacts 320 are inserted into one of the cavities 234 of the contact retention housing 230.

Figures 26, 27:
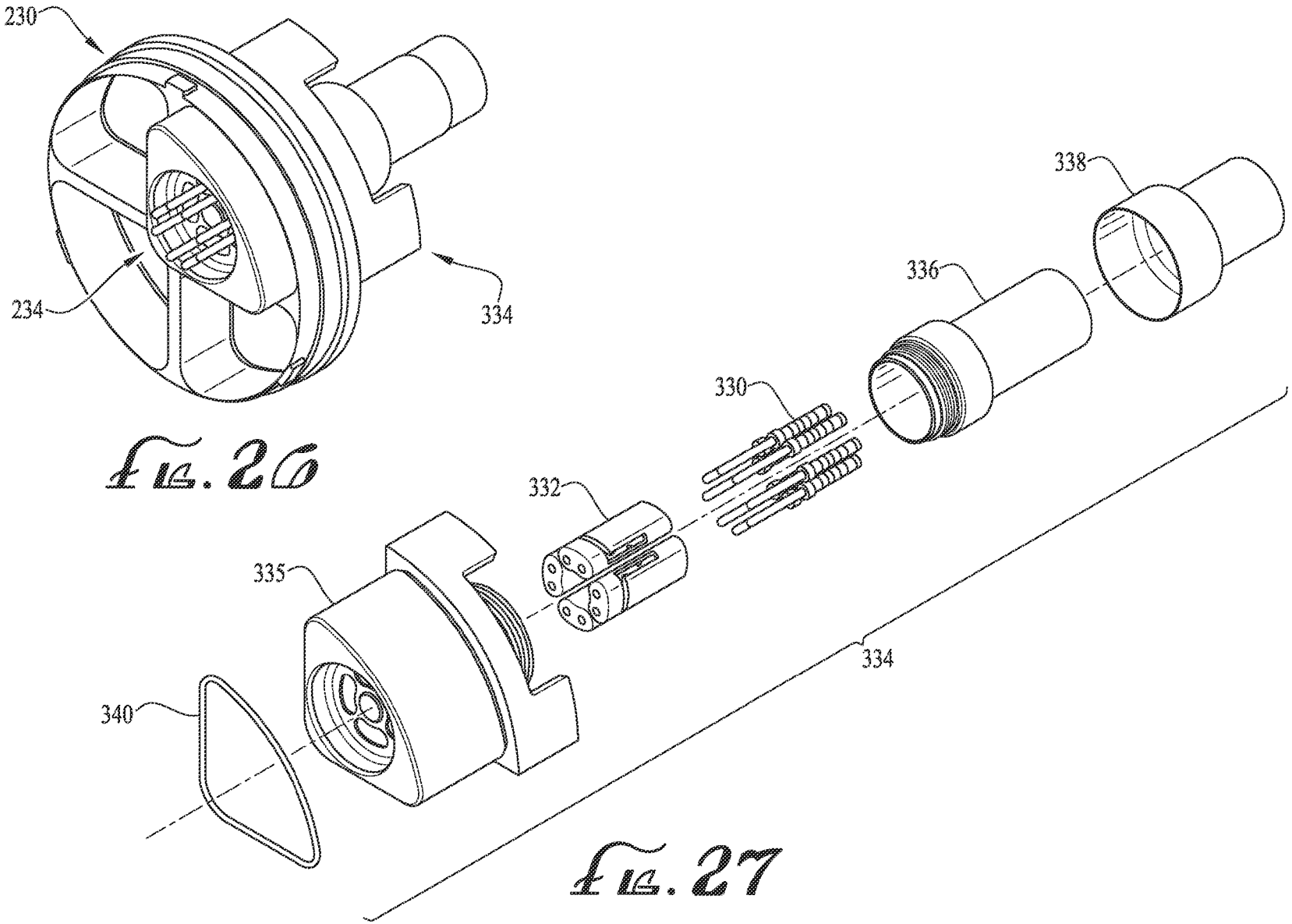

FIGS. 26 and 27 collectively illustrate details of a fourth multi-part housing structure or insert 334 having a fourth plurality of contacts 330 arranged therein for the electrical connector system 100, where the contacts 330 may be different than contacts 240, 288, 320 of the previous embodiments. With reference to FIGS. 26 and 27, in one embodiment, the plurality of contacts 330 may be arranged in groups of eight in a similar fashion as described in the high-density electrical connector of U.S. Pat. No. 9,306,333, the disclosure of which is incorporated herein in its entirety.

With reference to FIG. 27, the plurality of contacts 330 may be housed in sets of two within electrically insulating (or electrically non-conductive) sheaths 332 to physically separate the pin contacts 330 from one another. An insert 334 (similar to insert 212 of FIG. 5) includes a body 335 with a plurality of cavities (not shown) for housing and arranging the sheaths 332 and contacts 330. In a similar fashion as the insert 212 of FIG. 5, the cavities are physically separated from one another via a conductive core (not shown) and fins (not shown) radiating outwardly from the core, where each cavity extends in an axial direction entirely through the body 335. The pin contacts 330 are retained by the sheaths 332, which in turn are retained in position within the body 335 via housing member 336 and housing member 338, which is in turn threaded onto the body 335. In some embodiments, a gasket 340 may be positioned on the body 335 as illustrated in FIG. 27 to ensure proper sealing when the insert 334 is positioned within the contact retention housing 230.

As described, the contact assemblies 110, 228 each include a variety of different contact layouts designed to sit within a respective contact retention housing 112, 230 to create a multi-functional electrical connector system 100. As noted previously with reference to FIGS. 1-4, the electrical connector system 100 houses the contact assemblies 110, 228 within a variety of interlocking components including the backshell 102, plug shell with a coupling nut 104, receptacle shell 106, and the backshell 108. With reference to FIGS. 28-37, the following provides additional details relating to particular features for improved and more secure mating of the backshell 102 and the backshell 108 in accordance with another embodiment.

Figures 28, 29:
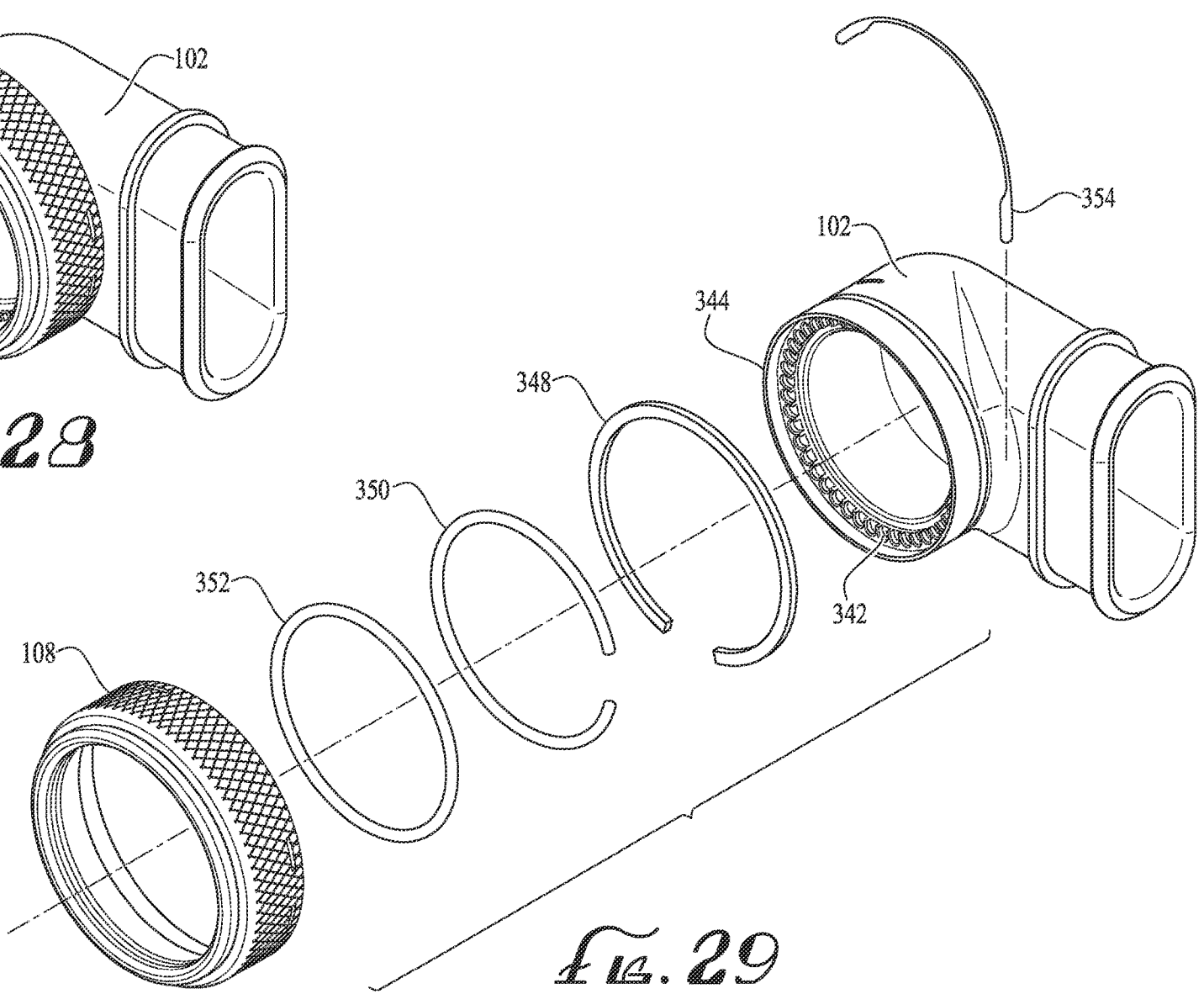
FIGS. 28-34 collectively illustrate various embodiments for backshells and backshell adaptors that may be used in conjunction with the electrical connector system of FIGS. 1 and 2.

FIGS. 28 and 29 collectively illustrate details of the backshell 102 of the electrical connector 100 of FIG. 1 in accordance with one embodiment. The backshell 102 may be a 90° standard backshell having a bend portion as illustrated. The backshell 102 includes a plurality of teeth 342 formed along an interior portion adjacent an open end 344 of the backshell 102. The teeth 342 may be regularly spaced-apart features, such as a series of evenly spaced vertical grooves, ridges, or other suitable features. In some embodiments, the teeth 342 are formed at approximately 8.18-degree intervals along the interior portion of the backshell 102 for a total of 44 evenly-spaced teeth. In other embodiments, the backshell 102 may have more or fewer teeth that may be spaced apart at various intervals as desired. The teeth 342 on the backshell 102 mate with teeth 346 on the plug shell 104 to tightly secure the components together and lock at approximately 8.18-degree intervals (see FIGS. 1 and 4).

With reference to FIG. 29, a ring 348 may help retain the backshell 108 together with the backshell 102 when assembled. In addition, a second retaining ring 350 may be used to retain the contact assembly inserts (e.g., pin contact assembly 228) in position within the backshell 102. A gasket or O-ring 352 may also be used to seal the interior portion of the backshell 102 when assembled with the backshell 108 (see FIG. 28). Once the backshell 102 and backshell 108 are mated, a lock wire 354 may be used to mechanically lock the components together.

Figure 30:
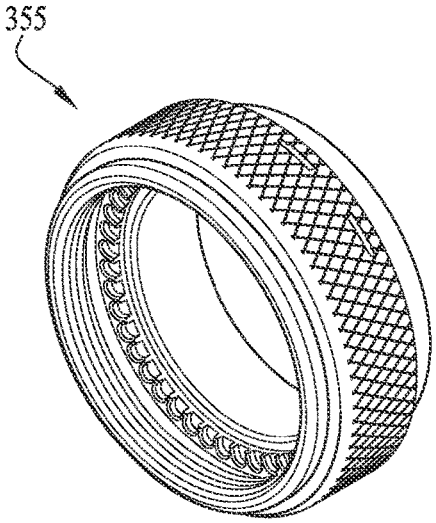
Figure 31:
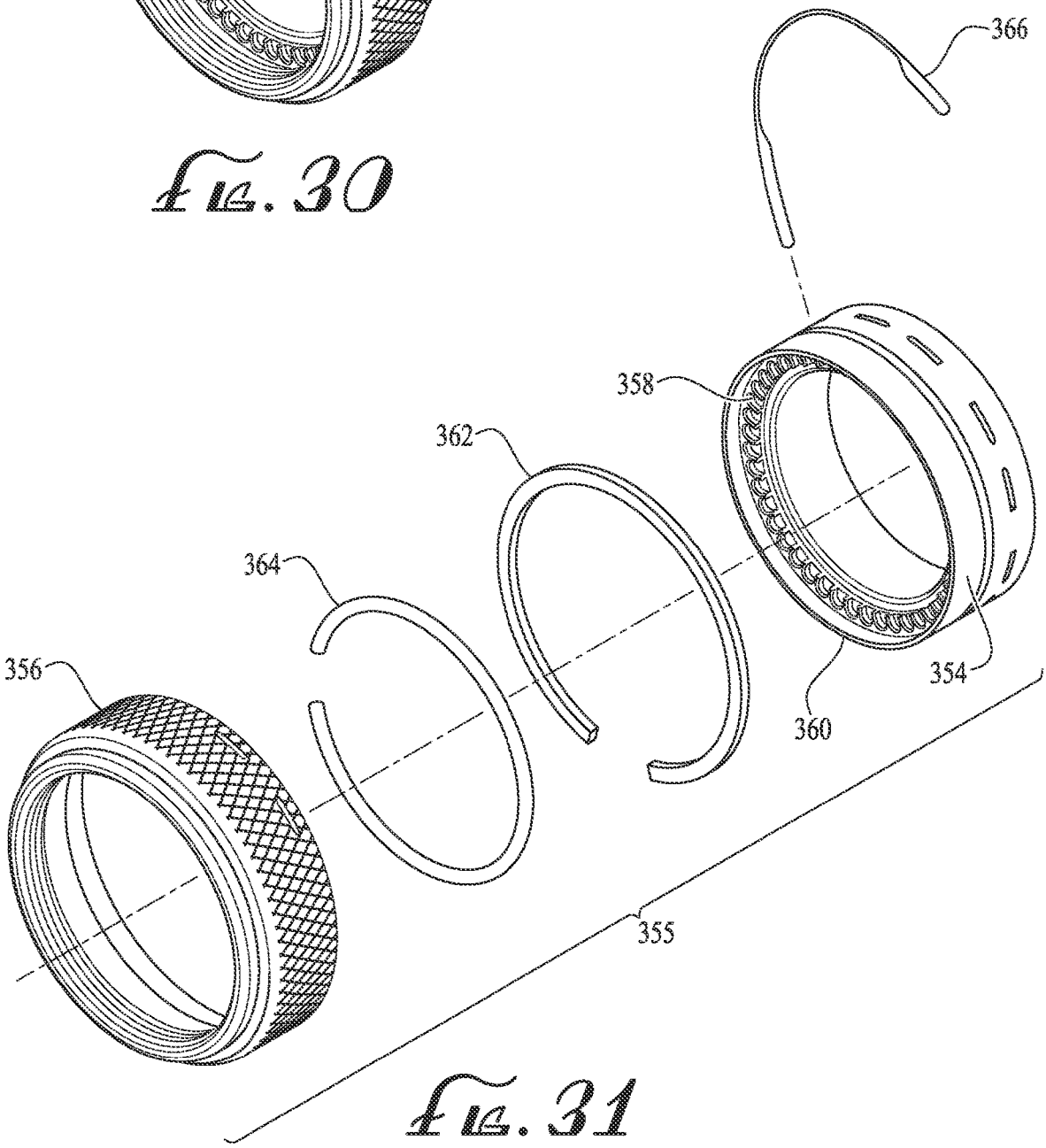

FIGS. 30 and 31 collectively illustrate another embodiment of a shell 355 including a backshell adaptor 354 and a coupling nut 356. With reference to the figures, the backshell adaptor 354 includes a plurality of teeth 358 formed along an interior portion adjacent an open end 360 of the backshell adaptor 354. The teeth 358 may be regularly spaced-apart features, such as a series of evenly spaced vertical grooves, ridges, or other suitable features. In some embodiments, the teeth 358 are formed at approximately 8.18-degree intervals along the interior portion of the backshell adaptor 354 for a total of 44 evenly-spaced teeth. In other embodiments, the backshell adaptor 354 may have more or fewer teeth that may be spaced apart at various intervals as desired. With reference to FIG. 31, a ring 362 may help retain the coupling nut 356 together with the backshell 354 when assembled. In addition, a second retaining ring 364 may be used to retain the contact assembly inserts (e.g., pin contact assembly 228) in position within the backshell adaptor 354. Once the backshell adaptor 354 and coupling nut 356 are mated, a lock wire 366 may be used to mechanically lock the components together. As illustrated, the shell 355 may be used for a box (line replaceable unit) mounted connector where a typical backshell is not needed. The backshell adaptor 354 includes a straight cable exit with a smooth, rounded exit to protect the cable.

Figure 32:
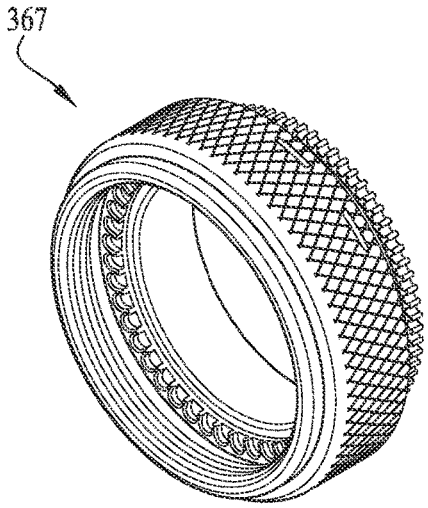
Figure 33:
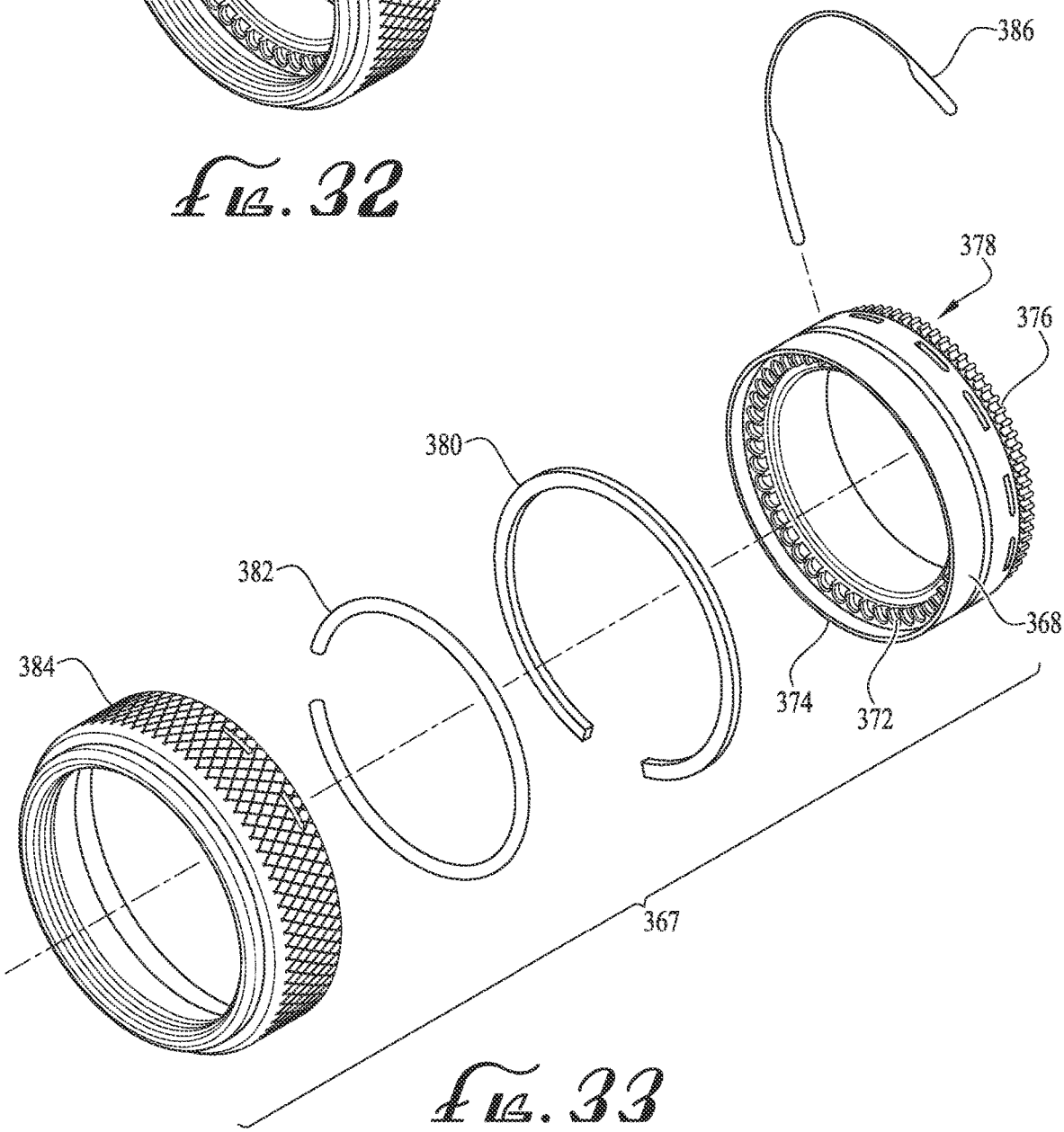
Figure 34:
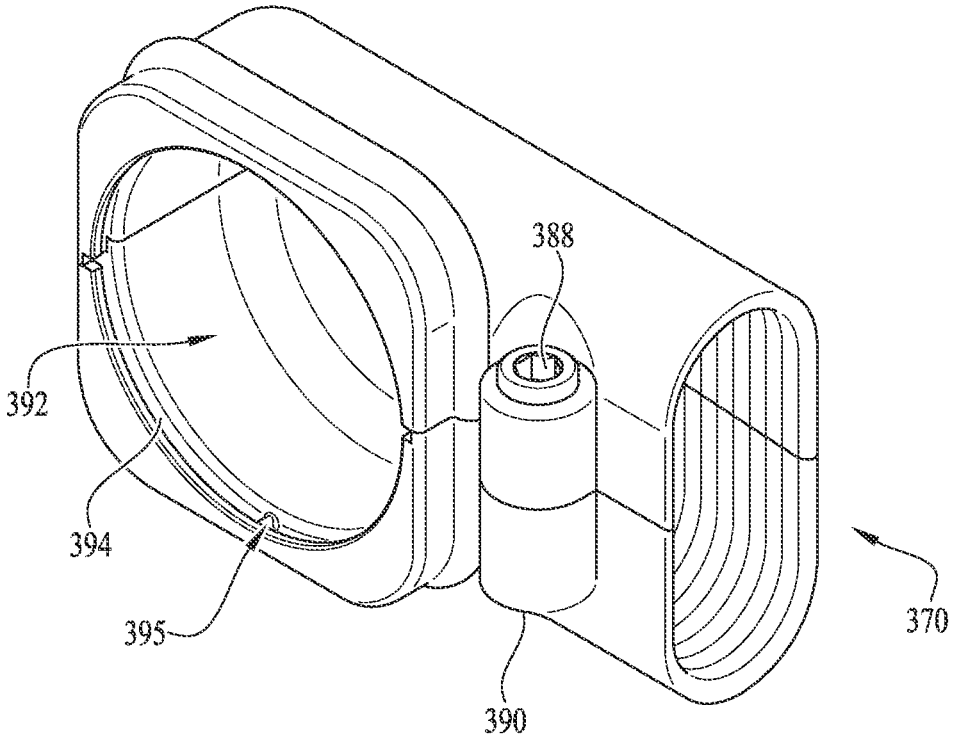

FIGS. 32 and 33 collectively illustrate another embodiment of a shell 367 for use with a split backshell design, such as backshell 370 (see FIG. 34). The shell 367 includes a backshell adaptor 368 having a plurality of teeth 372 formed along an interior portion adjacent an open front end 374 of the backshell adaptor 368. The teeth 372 may be regularly spaced-apart features, such as a series of evenly spaced vertical grooves, ridges, or other suitable features. In some embodiments, the teeth 372 are formed at approximately 8.18-degree intervals along the interior portion of the backshell adaptor 368 for a total of 44 evenly-spaced teeth. In other embodiments, the backshell adaptor 368 may have more or fewer teeth that may be spaced apart at various intervals as desired.

As illustrated in FIG. 33, the backshell adaptor 368 further includes a plurality of exterior teeth 376 formed along the circumference of a rear portion 378 of the backshell adaptor 368. The teeth 376 are formed at approximately 5-degree intervals along the exterior portion of the backshell adaptor 368 for a total of 72 evenly-spaced teeth. In other embodiments, the backshell adaptor 368 may have more or fewer teeth that may be spaced apart at various intervals as desired. When assembled, a ring 380 may help retain the coupling nut 384 together with the backshell adaptor 368. In addition, a second retaining ring 382 may be used to retain the contact assembly inserts (e.g., pin contact assembly 228) in position within the backshell adaptor 368. Once the backshell adaptor 368 and coupling nut 384 are mated, a lock wire 386 may be used to mechanically lock the components together.

With reference to FIG. 34, the backshell 370 may include two clamshell housing sections that may be fastened or mounted together, such as by inserting a fastener 388 in a mount 390 of the backshell 370. As assembled, the backshell 370 (such as the 90° backshell) includes an opening 392 on a front face thereof, and an internal channel 394 extending along the entirety of an interior portion of the backshell 370. The channel 394 for each clamshell housing section includes a raised tooth 395 formed therein, wherein the raised tooth 395 allows the backshell adaptor 368 to be installed in any orientation and secured with coupling nut 384 and lock wire 386. In an assembled configuration, the exterior teeth 376 of the backshell adaptor 368 are positioned within the internal channel 394 of the backshell 370 and engage the raised tooth 395 of each clamshell housing section. In this configuration, the teeth 376 help arrest movement of the coupling nut 384 to help prevent undesirable loosening and/or rotation (such as may occur in response to vibrations or other external forces), and the raised tooth 395 accommodates axial rotation at approximately 5-degree intervals for the backshell 370. In other embodiments, the backshell 370 may include various body designs other than those illustrated in the figures, where the backshell 370 may feature different curves and bends. Each of these embodiments of the backshell 370 may be assembled in a substantially similar configuration as described above.

As described, the disclosed subject matter provides details for an electrical connector system having a streamlined design for use in aerospace and other suitable applications. The electrical connector system is designed to provide flexibility for accommodating various types of contact layouts to provide multi-functional capabilities to a single electrical connector. In addition, the electrical connector system may be adapted for use with different backshell designs as needed for particular functions and environments of use, and to simplify assembly without the need of special tools.

Although the description above contains much specificity, these details should not be construed as limiting the scope of the invention, but as merely providing illustrations of some embodiments of the invention. It should be understood that subject matter disclosed in one portion herein can be combined with the subject matter of one or more of other portions herein as long as such combinations are not mutually exclusive or inoperable. The terms and descriptions used above are set forth by way of illustration only and are not meant as limitations. It will be obvious to those having skill in the art that many changes may be made to the details of the above-described embodiments without departing from the underlying principles of the invention. Those having skill in the art should understand that other embodiments than those described herein are possible.

The invention claimed is:

1. An electrical connector system comprising:

a first shell having a cavity; and a first electrical contact assembly housed within the cavity of the first shell, the first electrical contact assembly including:

a first contact housing including a plurality of housing-receiving cavities;

a first housing structure having a first plurality of electrical contacts housed therein, the first housing structure seated within a first housing-receiving cavity of the plurality of housing-receiving cavities of the first contact housing; and a second housing structure having a second plurality of electrical contacts housed therein, the second housing structure seated within a second housing-receiving cavity of the plurality of housing-receiving cavities of the first contact housing, wherein the first and second housing structures each includes a flange extending outwardly therefrom, the electrical connector further including a fastener extending into the first contact housing, the fastener engaging the flanges of the first and second housing structures to retain the first and second housing structures within the first contact housing;

a second shell having a cavity;

a second electrical contact assembly housed within the cavity of the second shell, the second electrical contact assembly including:

a first contact housing including a plurality of housing-receiving cavities;

a first housing structure having a third plurality of electrical contacts housed therein, the first housing structure seated within a first housing-receiving cavity of the plurality of housing-receiving cavities of the first contact housing; and a second housing structure having a fourth plurality of electrical contacts housed therein, the second housing structure seated within a second housing-receiving cavity of the first contact housing, wherein when the first and second shells are coupled with one another, the first plurality of electrical contacts of the first electrical contact assembly mates with the third plurality of electrical contacts of the second electrical contact assembly, and the second plurality of electrical contacts of the first electrical contact assembly mates with the fourth plurality of electrical contacts of the second electrical contact assembly.

2. The electrical connector system of claim 1, wherein the first contact housing of the first electrical contact assembly further includes a core extending along an axial direction and a plurality of fins radiating outwardly from the core, each of the fins separating adjacent housing-receiving cavities from one another.

3. The electrical connector system of claim 2, wherein the fastener extends into the core of the first contact housing of the first electrical contact assembly.

4. The electrical connector system of claim 1, wherein the first and second plurality of electrical contacts of the first electrical contact assembly are different from one another.

5. The electrical connector system of claim 4, wherein the third and fourth plurality of electrical contacts of the second electrical contact assembly are different from one another.

6. The electrical connector system of claim 1, the first electrical contact assembly further comprising a third housing structure having a fifth plurality of electrical contacts housed therein, the third housing structure seated within a third housing-receiving cavity of the plurality of housing-receiving cavities of the first contact housing, wherein the first, second, and fifth plurality of electrical contacts are different from one another.

7. The electrical connector system of claim 6, the second electrical contact assembly further comprising a third housing structure having a sixth plurality of electrical contacts housed therein, the third housing structure seated within a third housing-receiving cavity of the plurality of housing-receiving cavities of the second contact housing, wherein the third, fourth, and sixth plurality of electrical contacts are different from one another.

8. The electrical connector system of claim 7, the first electrical contact assembly further comprising a fourth housing structure having a seventh plurality of electrical contacts housed therein, the fourth housing structure seated within a fourth housing-receiving cavity of the plurality of housing-receiving cavities of the first contact housing, and the second electrical contact assembly further comprising a fourth housing structure having an eighth plurality of electrical contacts housed therein, the fourth housing structure seated within a fourth housing-receiving cavity of the plurality of housing-receiving cavities of the second contact housing.

9. The electrical connector system of claim 1, wherein the first and second housing structures of the second electrical contact assembly each include a flange extending outwardly therefrom, the electrical connector further including a second fastener extending into the first contact housing of the second electrical contact assembly, the second fastener engaging the flange of the first and second housing structures to retain the first and second housing structures within the first contact housing of the second electrical contact assembly.

10. The electrical connector system of claim 9, wherein the first contact housing of the second electrical contact assembly further includes a core extending along an axial direction and a plurality of fins radiating outwardly from the core, each of the fins separating adjacent housing-receiving cavities from one another.

11. The electrical connector system of claim 10, wherein the second fastener extends into the core of the first contact housing of the second electrical contact assembly.

12. The electrical connector system of claim 11, wherein the third and fourth plurality of electrical contacts are different from one another.

13. The electrical connector system of claim 1, the first housing structure of the first electrical contact assembly further including a first housing subassembly including a first plurality of contact-receiving cavities extending therethrough along an axial direction, wherein each electrical contact of the first plurality of electrical contacts is seated within a corresponding one of the first plurality of contact-receiving cavities, and wherein the first electrical contact assembly further includes a contact-retention clip seated within each of the first plurality of contact-receiving cavities, each contact-retention clip coupled to a corresponding one of the electrical contacts to retain the electrical contact within the contact-receiving cavity.

14. The electrical connector system of claim 13, the first housing structure of the first electrical contact assembly further including a second housing subassembly including a second plurality of contact-receiving cavities extending therethrough in the axial direction, wherein the first and second plurality of contact-receiving cavities are co-aligned when the first and second housing subassemblies are coupled, and wherein each electrical contact of the first plurality of electrical contacts is seated within a corresponding one of the first and second plurality of contact-receiving cavities.

15. The electrical connector system of claim 14, the first housing structure of the second electrical contact assembly further including a first housing subassembly including a first plurality of contact-receiving cavities extending therethrough along an axial direction, wherein each electrical contact of the third plurality of electrical contacts is seated within a corresponding one of the first plurality of contact-receiving cavities, and wherein the second electrical contact assembly further includes a contact-retention clip seated within each of the first plurality of contact-receiving cavities, each contact-retention clip coupled to a corresponding one of the electrical contacts to retain the electrical contact within the contact-receiving cavity.

16. The electrical connector system of claim 15, the first housing structure of the second electrical contact assembly further including a second housing subassembly including a second plurality of contact-receiving cavities extending therethrough along the axial direction, wherein the first and second plurality of contact-receiving cavities are co-aligned when the first and second housing subassemblies are coupled, and wherein each electrical contact of the plurality of third electrical contacts is seated within a corresponding one of the first and second plurality of contact-receiving cavities.

17. The electrical connector system of claim 14, the first housing structure further including a third housing subassembly including a third plurality of contact-receiving cavities extending therethrough in the axial direction, wherein the first, second, and third plurality of contact-receiving cavities are co-aligned when the first, second, and third housing subassemblies are coupled, and wherein each electrical contact of the first plurality of electrical contacts is seated within a corresponding one of the first, second, and third plurality of contact-receiving cavities.

18. The electrical connector system of claim 17, wherein the second housing subassembly further includes a wall extending around an exterior boundary thereof, and wherein a peripheral surface of the third housing subassembly is seated against the wall when the second and third housing subassemblies are coupled.

* * * * *